US006795667B2

(12) United States Patent
Nakazawa et al.

(10) Patent No.: US 6,795,667 B2
(45) Date of Patent: Sep. 21, 2004

(54) PROCESS CARTRIDGE AND ELECTROPHOTOGRAPHIC APPARATUS HAVING AN INTERMEDIATE TRANSFER BELT

(75) Inventors: Akihiko Nakazawa, Shizuoka (JP); Hiroyuki Kobayashi, Shizuoka (JP); Atsushi Tanaka, Shizuoka (JP); Tsunenori Ashibe, Kanagawa (JP); Takashi Kusaba, Shizuoka (JP); Hidekazu Matsuda, Shizuoka (JP); Yuji Sakurai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,352

(22) Filed: Aug. 30, 2002

(65) Prior Publication Data

US 2003/0118369 A1 Jun. 26, 2003

(30) Foreign Application Priority Data

Aug. 31, 2001 (JP) ..... 2001-263905

(51) Int. Cl.[7] ..... G03G 15/00

(52) U.S. Cl. ..... 399/111; 399/66; 399/302; 399/308

(58) Field of Search ..... 399/111, 299, 399/308, 66, 302

(56) References Cited

U.S. PATENT DOCUMENTS

| | | | | |
|---|---|---|---|---|
| 4,873,548 | A | 10/1989 | Kobayashi | 355/200 |
| 5,116,711 | A | 5/1992 | Kobayashi et al. | 430/106 |
| 5,149,610 | A | 9/1992 | Kobayashi et al. | 430/106 |
| 5,164,275 | A | 11/1992 | Kobayashi et al. | 430/45 |
| 5,256,512 | A | 10/1993 | Kobayashi et al. | 430/106 |
| 5,331,373 | A | 7/1994 | Nomura et al. | 355/200 |
| 5,440,373 | A | 8/1995 | Deki et al. | 355/210 |
| 5,446,525 | A | 8/1995 | Kobayashi | 355/210 |
| 5,452,056 | A | 9/1995 | Nomura et al. | 355/200 |
| 5,585,889 | A | 12/1996 | Shishido et al. | 355/200 |
| 5,585,902 | A | 12/1996 | Nishiuwatoko et al. | 355/260 |
| 5,587,769 | A | 12/1996 | Sawada et al. | 355/200 |
| 5,713,067 | A | 1/1998 | Mizoe et al. | 399/176 |
| 5,752,131 | A | 5/1998 | Fujiwara et al. | 399/106 |
| 5,802,427 | A | 9/1998 | Sawada et al. | 399/122 |
| 5,870,654 | A | 2/1999 | Sato et al. | 399/109 |
| 5,966,566 | A | 10/1999 | Odagawa et al. | 399/109 |
| 5,991,570 | A * | 11/1999 | Haga et al. | 399/114 |
| 6,408,158 | B1 * | 6/2002 | Takahata et al. | 399/302 |

FOREIGN PATENT DOCUMENTS

| | | |
|---|---|---|
| JP | 63-301960 | 12/1988 |
| JP | 6-110261 | 4/1994 |
| JP | 8-137181 | 5/1996 |
| JP | 10-177329 | 6/1998 |
| JP | 11-30944 | 2/1999 |

* cited by examiner

*Primary Examiner*—Quana Grainger
(74) *Attorney, Agent, or Firm*—Fitzpatrick, Cella, Harper & Scinto

(57) ABSTRACT

A process cartridge which is detachably mountable to a main body of an electrophotographic apparatus, includes an electrophotographic photosensitive member to carry a toner image; an intermediate transfer belt having a contact part with the photosensitive member, and a primary transfer unit to primarily transfer the toner image at the contact part from the photosensitive member to the intermediate transfer belt, being integrally supported in one body. After the contact part is formed by the photosensitive member and the intermediate transfer belt is brought into contact with under a linear pressure of 0.5 N/cm and is left for 10 hours in an environment of 45° C./95% RH, differences in the dark portion potential and the light portion potential of the photosensitive member between the contact part and the non-contact part of the photosensitive member are respectively less than 20%, and no crack having a length of not less than 1 mm occurs in any of the surfaces of the photosensitive member and the intermediate transfer belt. An electrophotographic apparatus having the process cartridge is also disclosed.

35 Claims, 8 Drawing Sheets

PROCESS CARTRIDGE AND ELECTROPHOTOGRAPHIC APPARATUS HAVING AN INTERMEDIATE TRANSFER BELT

BACKGROUND OF THE INVENTION

1. Field of the Invention

The present invention relates to a process cartridge and an electrophotographic apparatus, and in particular to an intermediate transfer belt-electrophotographic photosensitive member integrated process cartridge and an electrophotographic apparatus having the process cartridge.

2. Related Background Art

An image forming apparatus of an electrophotographic system (electrophotographic apparatus) using a belt-shaped intermediate transferring member (intermediate transfer belt) is effective as a color electrophotographic apparatus and as a multi-color image forming apparatus which brings a plurality of component color images of color image information or multi-color image information into sequential lamination transfer so as to output image formed matter synthesized and reproduced from color images and multi-color images.

Compared with a conventional color electrophotographic apparatus (for example, Japanese Patent Application Laid-Open No. 63-301960, etc.) of a system in which images are transferred from an electrophotographic photosensitive member to a transfer material fastened or attracted onto a transferring drum, a color electrophotographic apparatus using an intermediate transfer belt does not require any processing or control (for example, prehension to a gripper or absorbing, giving curvature, etc.) on the transfer material but can transfer images from the intermediate transfer belt, and therefore has an advantage that various kinds of transfer material can be selected regardless of wideness/narrowness of the width or the longness/shortness of the length to cover thin paper (40 g/m$^2$ paper) to thick paper (200 g/m$^2$ paper) such as envelopes, postcards, and label forms, etc.

In addition, compared with such a case where an intermediate transfer member (intermediate transfer drum) in a rigid drum shape is used, adopting an intermediate transfer belt shape for the intermediate transfer member, freedom for disposing inside an electrophotographic apparatus increases, giving rise to an advantage that miniaturization or cost reduction of the main body of the electrophotographic apparatus can be implemented by efficiently utilizing spaces.

In addition, as a photoconductive material used for the electrophotographic photosensitive member which the electrophotographic apparatus comprises, inorganic materials such as zinc oxide, selenium and cadmium sulfide, etc. are known.

As compared with inorganic materials, organic materials such as polyvinyl carbazole, phthalocyanine, and azo pigment have advantages such as high production efficiency or pollution-free performance, and in particular are superior in photoconductivity. Organic electrophotographic photosensitive members using such organic materials are widely used for electrophotographic apparatuses.

An intermediate transfer belt repeatedly receives bending stress and contact with or rubbing from various kinds of drive members and transfer members, etc., every time it rotates, and with a high potential being applied, its life is shorter than the main body of an electrophotographic apparatus, and replacement is indispensable under the current state.

Likewise, the electrophotographic photosensitive member is also repeatedly affected by electrification, exposure, development, transfer, cleaning, and dielectrification, and therefore requires various chemical or physical endurance, and thus an organic electrophotographic photosensitive member needs to be replaced as well.

Otherwise, waste toner having collected residual toner on an intermediate transfer belt needs treatment, and a lot of components such as an electrophotographic photosensitive member, developing means and toner, etc. need replacement and maintenance.

As a method to unitize these replacement components and attach to/remove from the main body of an electrophotographic apparatus easily, Japanese Patent Application Laid-Open No. 8-137181 proposes to dispose an intermediate transfer belt and an electrophotographic photosensitive member as respectively independent units detachably mountable to the main body of an electrophotographic apparatus without difficulty.

However, these means involve a number of replacement units to make the user's operation complicated. Moreover, the intermediate transfer unit and the electrophotographic photosensitive member unit are respectively designed and disposed independently, thereby causing such a problem that the main body of the electrophotographic apparatus becomes larger or costs increase.

As a means to solve this problem, replacing means to cause the intermediate transfer belt and the electrophotographic photosensitive member (replacement parts) to be supported integrally as one body in one unit, and to be constructed so as to cause it to be simultaneously removed from/attached to the main body of the electrophotographic apparatus are suitable, and are proposed in Japanese Patent Application Laid-Open No. 6-110261, Japanese Patent Application Laid-Open No.10-177329, and Japanese Patent Application Laid-Open No. 11-30944.

However, the method to construct the intermediate transfer belt and the electrophotographic photosensitive member as one-body unit to become an intermediate transfer belt-electrophotographic photosensitive member integrated process cartridge that is detachably mountable to the main body of the electrophotographic apparatus gives rise to several problems originated from the intermediate transfer belt.

In particular, what causes a big problem is a characteristic abnormality of the electrophotographic photosensitive member and the intermediate transfer belt that takes place when the intermediate transferring member and the electrophotographic photosensitive member are left to stand for a long time while they are integrally provided under a state of one body.

The electrophotographic photosensitive member as well as the intermediate transfer belt contain various materials being mixed in order to obtain required functions, and among those materials some may affect adversely each other by being left for a long time.

For example, in case when a material permeating into constructing components, such as a binder resin, to make it plastic or a material influencing movement of electric charges, are attached, in particular, an organic electrophotographic photosensitive member is apt to be influenced thereby.

In the case of matter influencing movements of electric charges being attached to the electrophotographic photosensitive member, the difference in sensitivity characteristic is brought about in that portion, giving rise to a density difference from the neighborhood at the time of printing to provide an abnormal image.

Also, as for the intermediate transfer belt, partial changes in electric characteristics such as resistance or capacity will result in transfer unevenness, which will appear in the image.

The most serious problem is the case where a crack occurs in the photosensitive layer due to the matter having migrated from the intermediate transfer belt. Such a crack is remarkable in the thickest layer among the layers constituting the photosensitive layer, and is apt to occur in the photosensitive layer and in the charge transport layer in case of lamination type photosensitive layers.

Such a phenomenon that a crack occurs in the electrophotographic photosensitive member or a shift in matter influencing movements of electric charges takes place remarkably in a portion (contact part) where the intermediate transfer belt and electrophotographic photosensitive member are brought into contact, but in case of the matter in question being volatile, not only the contact part but also the neighborhood is affected so that unevenness in the image density is caused to take place.

Accordingly, even if the intermediate transfer belt and the electrophotographic photosensitive member are not always brought into contact, in case of an intermediate transfer belt-electrophotographic photosensitive member integrated process cartridge which is disposed in the same housing, leaving the integrated process cartridge to stand for a long time could give rise to an abnormal image.

Such a phenomenon has been found out to be accelerated faster in particular in an environment of higher temperature, and also as for moisture, higher moisture tends to give rise to bad effects, and therefore, it is necessary that no problem occurs in the intermediate transfer belt-electrophotographic photosensitive member integrated process cartridge due to temperature and humidity applied during the distribution stage.

On the other hand, in many cases this phenomenon will not be problematic very much after the electrophotographic apparatus has been installed and started to be used.

The reason thereof is as follows: the environment in which an electrophotographic apparatus, such as a photocopier or a printer, is used seldom becomes an environment of high temperature and high humidity the same as those applied during the physical distribution, and moreover, when an image is formed, a part of the toner used and an external additive on the surface of the toner particles, although in a very small quantity, remains between the electrophotographic photosensitive member and the intermediate transfer belt so that mutual material movements between the electrophotographic photosensitive member and the intermediate transfer belt are prevented.

In particular, in recent years, the technology of electrophotographic apparatus has progressed, and for a printer or a photocopier of a digital developing system, enhancement in size reduction or the high density of an exposing spot diameter has enabled delicate pixel development with 600 dpi or more, and in addition thereto, precise control of an electric field, etc., has made a high quality image available.

As a result, a minor abnormality of the electrophotographic photosensitive member and the intermediate transferring member, which has caused no trouble in the conventional techniques, may influence image quality, and a solution of this problem is important.

However, in the above described conventional technology, measures are not taken to cope with such a situation that the intermediate transfer belt-electrophotographic photosensitive member integrated process cartridge left standing for a long time during transportation and storage, and no distribution process is taken into consideration in designing the integrated process cartridge, giving rise to a possibility of damaging the image quality unless the storage management and service period are severely controlled on the process cartridge and bringing about problems such as increased management costs and user frequent complaints.

In addition, reduction of running costs is an important problem, and thus the intermediate transfer belt-electrophotographic photosensitive member integrated process cartridge as a replacement part needs further cost reduction, and therefore in order to make handling easy, attention must be paid to miniaturization as well as treatment of waste toner as well.

As above, those which have solved the problems in the intermediate transfer belt-electrophotographic photosensitive member integrated process cartridge are not yet available.

SUMMARY OF THE INVENTION

The object of the present invention is to solve the above described problems and to provide a process cartridge that makes maintenance easy, can attain miniaturization as well as cost reduction of the electrophotographic apparatus which is attached/removed, and can provide good images, and an electrophotographic apparatus having the process cartridge.

The present invention provides a process cartridge which is detachably mountable to a main body of an electrophotographic apparatus, integrally comprising:

an electrophotographic photosensitive member to carry a toner image;

an intermediate transfer belt having a contact part with the electrophotographic photosensitive member, and primary transfer means to primarily transfer the toner image at the contact part from the electrophotographic photosensitive member to the intermediate transfer belt, wherein after the contact part is formed by the electrophotographic photosensitive member and the intermediate transfer belt being brought into contact with each other under a linear pressure of 0.5 N/cm and left to stand for 10 hours in an environment of 45° C./95% RH, differences in the dark portion potential and the light portion potential of the electrophotographic photosensitive member between the contact part and the portion being not the contact part of the electrophotographic photosensitive member are respectively less than 20%, and no crack having a length of not less than 1 mm occurs in any of the surface of the electrophotographic photosensitive member and the surface of the intermediate transfer belt.

In addition, the present invention provides an electrophotographic apparatus comprising:

an electrophotographic photosensitive member to carry a toner image;

charging means to electrically charge the electrophotographic photosensitive member;

exposing means to form an electrostatic latent image on the electrophotographic photosensitive member charged with the charging means;

developing means to develop with a toner the electrostatic latent image formed with the exposing means on the electrophotographic photosensitive member to form a toner image on the electrophotographic photosensitive member;

an intermediate transfer belt having a contact part with the electrophotographic photosensitive member to perform, after primary transfer of the toner image from the electrophotographic photosensitive member to the intermediate transfer belt, secondary transfer of the primarily transferred toner image to a transfer material; and primary transfer means to primarily transfer the toner image from the electrophotographic photosensitive member to the intermediate transfer belt at the contact part; and comprising a process cartridge integrally supporting at least the electrophotographic photosensitive member, the intermediate transfer belt, and the primary transfer means and being freely detachably mountable to the electrophotographic apparatus main body, wherein after the contact part is formed by the electrophotographic photosensitive member and the intermediate transfer belt being brought into contact with each other under a linear pressure of 0.5 N/cm and left to stand for 10 hours in an environment of 45° C./95% RH, differences in the dark portion potential and the light portion potential of the electrophotographic photosensitive member between the contact part and the portion being not the contact part of the electrophotographic photosensitive member are respectively less than 20%, and no crack having a length of not less than 1 mm occurs in any of the surface of the electrophotographic photosensitive member and the surface of the intermediate transfer belt.

DETAILED DESCRIPTION OF THE PREFERRED EMBODIMENTS

Figure 1:
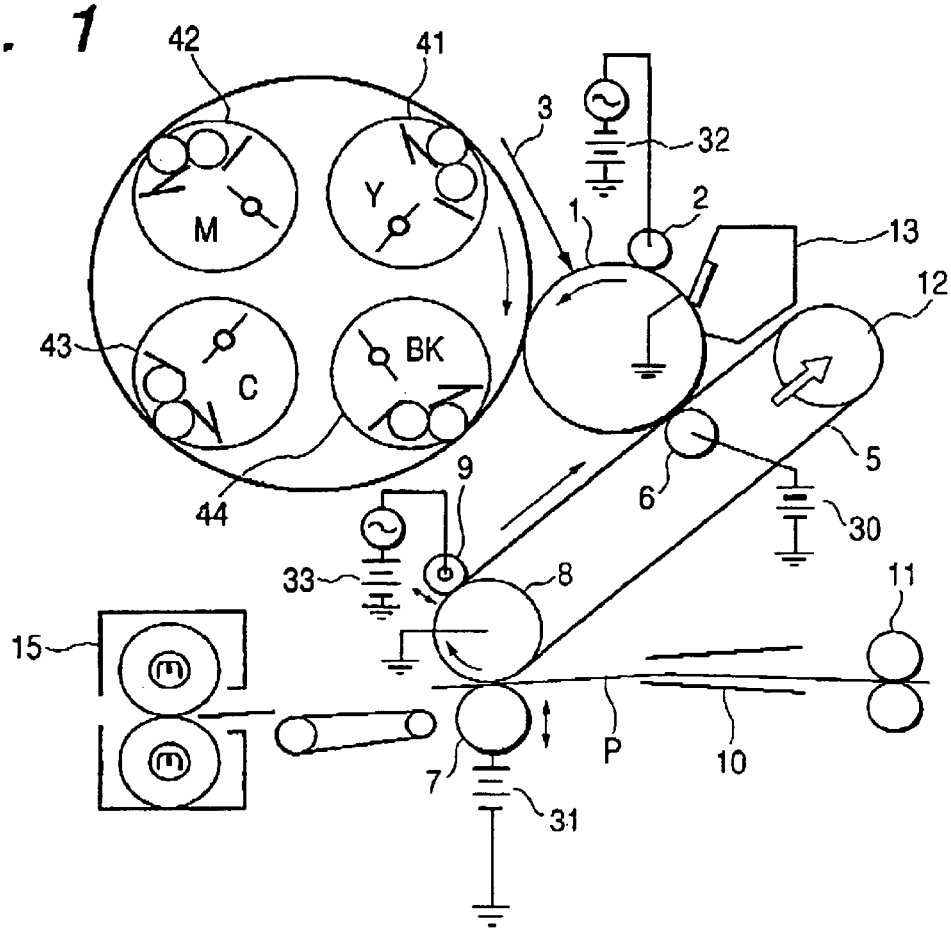
FIG. 1 is a schematic view of an electrophotographic apparatus comprising an intermediate transfer belt-electrophotographic photosensitive member integrated process cartridge of the present invention.

The present invention will be described in further detail below.

In the present invention, as a result of study on simplification of maintenance and miniaturization of the main body as well as the cartridge, enhancement in cost-saving and improvement of image quality, the initial goal has been attained by adopting several constructions together for a process cartridge in which an intermediate transfer belt and an organic electrophotographic photosensitive member are integrated, and also primary transfer means for primarily transferring a toner image on the electrophotographic photosensitive member to the intermediate transfer belt is further integrated.

That is, the present invention has the features that after the electrophotographic photosensitive member and the intermediate transfer belt are brought into contact with each other under a linear pressure of 0.5 N/cm to form a contact part, and are left to stand for 10 hours in an environment of 45° C./95% RH, differences in the dark portion potential and the light portion potential of the electrophotographic photosensitive member between the contact part and the part not in contact with the intermediate transfer belt (non-contact part) are respectively less than 20%, and no crack having a length of not less than 1 mm occurs in any of the surface of the electrophotographic photosensitive member and the surface of the intermediate transfer belt.

In the case where leaving the apparatus in the environment of 45° C./95% RH for 10 hours does not cause such a crack to occur, few problems are likely to occur under actual transportation and use conditions, and it can make good performance available as an intermediate transfer belt-electrophotographic photosensitive member integrated process cartridge.

It is more preferable to construct an apparatus that can be left for 336 hours in the above described environment without causing a crack having a length of not less than 1 $\mu$m to occur in any of the surface of the electrophotographic photosensitive member and the surface of the intermediate transfer belt.

In the case of the occurrence of a crack of not less than 1 $\mu$m, there may be no problem during the initial stage, but repeated image forming will enlarge the crack and bring toner into melt attachment thereto, giving rise to a problem that a blank area is formed in the image, and cracking or spot-like image occurs in the white background occur.

In addition, even if no crack occurs on the surface of the electrophotographic photosensitive member, if the differences in the dark portion potential and the light portion potential of the electrophotographic photosensitive member between the contact part and the non-contact part are respectively not less than 20%, streaks of thin density may appear on the solid image, and streaks of high density may occur on the light color image.

In particular, these image problems are remarkable in an electrophotographic apparatus of digital system with not less than 600 dpi.

In order to obtain such a characteristic, the materials that may migrate or move when the intermediate transfer belt and the electrophotographic photosensitive member are brought into contact need to be made less, or made into a form not apt to be moved, and there are several methods.

In particular, there are a method in which various kinds of additives such as resistance adjusting agent materials of high molecular weight that hardly move at the molecule level and conductive filler, such as carbon black, etc., are selected for use instead of movable materials having a low molecular weight, and a method in which the intermediate transfer belt and/or the electrophotographic photosensitive member is heated after being produced or is put under a reduced pressure and the like so that volatile components of low molecular weight are removed and the like.

In addition, there is a method in which an inert particle additive is mixed into or attached to the intermediate transfer belt and/or the electrophotographic photosensitive member to provide extreme micro protrusions on their surfaces so that the contact area therebetween is reduced and movement of matter is prevented, and a method in which the binder resin of the intermediate transfer belt and/or the electrophotographic photosensitive member is made into a form having a higher molecular weight or cross-linked so that movement of matter of low molecule weight is prevented and the like.

The layer containing charge transporting material that the electrophotographic photosensitive member used for the process cartridge of the present invention may preferably have a thickness of 10 to 60 $\mu$m, and more preferably 15 to 40 $\mu$m.

In addition, the charge transporting material may preferably have a content of 20 to 80% by weight, and more preferably 30 to 60% by weight based on the total weight of the layer that contains the charge transporting material.

When the layer containing the charge transporting material has a film thickness larger than 60 mm, or when the charge transporting material has a content of less than 20% by weight, the sensitivity may decrease.

On the other hand, in order to satisfy the above described feature in the present invention, the film thickness is preferably controlled to be not less than 10 $\mu$m, while the charge transporting material is preferably controlled to be not more than 80% by weight.

Exceeding these ranges, the durability of the intermediate transfer belt and the electrophotographic photosensitive member decreases, and at the time when the intermediate transfer belt and the electrophotographic photosensitive member are brought into contact at high temperature/high humidity and stored for a long period, it will become highly possible that a crack occurs in the intermediate transfer belt or the electrophotographic photosensitive member.

Here, the layer containing the charge transporting material refers to, in the case where the electrophotographic photosensitive member is a single layer type photosensitive layer containing the charge generation material and the charge transporting material in a single layer, that single layer type photosensitive layer, and, in the case where the photosensitive layer is a lamination type photosensitive layer which has a charge generation layer containing charge generation material and a charge transport layer containing charge transporting material in a laminated form, the layer containing the charge transporting material refers to the charge transport layer.

In terms of the electrophotographic properties, the layer construction of the photosensitive layer is preferably a lamination type photosensitive layer in which a charge generation layer and a charge transport layer are laminated in this order from the bottom.

In addition, as the binder resin to be utilized for the electrophotographic photosensitive member using organic photoconductive material, polyester, polyurethane, polyarylate, polyethylene, polystyrene, polybutadiene, polycarbonate, polyamide, polypropylene, polyimide, polyamideimide, polysulfone, polyaryl ether, polyacetal, phenolic resin, acrylic resin, silicone resin, epoxy resin, urea resin, allylic resin, alkyd resin, butyral resin, the like can be mentioned.

Among these, in particular, it is preferable that the charge transport layer contains polycarbonate or polyarylate as binder resin, from the point of view that such a phenomena that the additive existing in the electrophotographic photosensitive member, such as the charge transporting material in the present invention, is shifted to the intermediate transfer belt is made to hardly take place.

In addition, nothing in particular will limit the charge generation material as well as the charge transporting material if they can make features of the present invention available.

As the charge generation material, for example, phthalocyanine pigment, polycyclic pigment, azo pigment, perylene pigment, indigo pigment, quinacridone pigment, azurenium salt dye, squa-rylium dye, cyanine dye, pyrylium dye, thiopyrylium dye, xanthene pigment, quinoneimine pigment, triphenylmethane pigment, styryl pigment, selenium, selenium-tellurium, amorphous silicon, cadmium sulfide, and the like can be mentioned.

As the charge transporting material, pyrene compounds, carbazole compounds, hydrazone compounds, N,N-dialkylaniline compound, diphenylarnine compound, triphenylamine compound, triphenylmethane compounds, pyrazoline compounds, styryl compounds, stilbene compounds, and the like can be mentioned, but the charge transporting material having the structure represented by the following formula(1) or the charge transporting material having the structure represented by the following formula(2) is preferable from the point of view that those materials do not tend to move even when they are in contact with the intermediate transfer belt for a long period at high temperature and high humidity and no streak-like image defect due to the attachment of those materials to the intermediate transfer belt is formed and that electrifying deterioration is less and residual potential can be reduced with high sensitivity and the like.

(1)

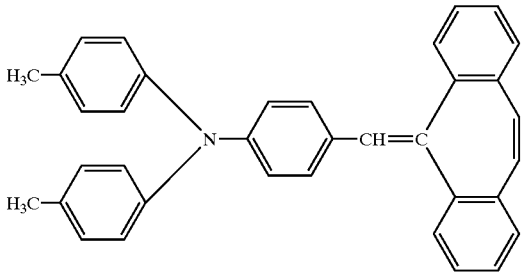

(2)

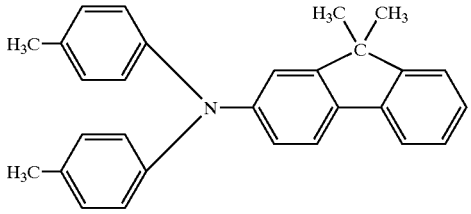

In addition, as the charge transporting material, the charge transporting material having the structure represented by the above described formula (1) and the charge transporting material having the structure represented by the above described formula (2) are preferably used together.

In addition, on the photosensitive layer, a protecting layer may be formed for the purpose of protecting the photosensitive layer.

The film thickness of the protecting layer is preferably 0.01 to 20 mm and moreover preferably 0.1 to 10 mm.

The protecting layer may contain the above described charge generation material or charge transporting material, metal as well as oxide thereof, nitrides, salts, alloy and, moreover, conductive material such as carbon.

As the binder resin to be used for the protecting layer, polyester, polyurethane, polyarylate, polyethylene, polystyrene, polybutadiene, polycarbonate, polyamide, polypropylene, polyimide, polyamideimide, polysulfone, polyallyl ether, polyacetal, phenolic resin, acrylic resin, silicone resin, epoxy resin, urea resin, allylic resin, alkyd resin, butyral resin, and the like can be nominated. Moreover, reactive epoxy, (meta) acrylic monomer or oligomer can be used after being subject to mixture and hardening.

In addition, as the supporting member used for the electrophotographic photosensitive member, metals such as iron, copper, nickel, aluminum, titanium, tin, antimony, indium, lead, zinc, gold and silver, alloy thereof, or oxides thereof or carbon, conductive resins and the like can be used. The shape of the supporting member includes a cylinder type, a belt type and a sheet type. In addition, the above described conductive material may be molded and processed, but may be coated as a paint or may be evaporated and deposited.

An intermediate layer may be provided between the supporting member and the photosensitive layer. The intermediate layer, which mainly consists of binder resin, may contain the above described conductive material or acceptor.

As the binder resin forming the intermediate layer, polyester, polyurethane, polyarylate, polyethylene, polystyrene, polybutadiene, polycarbonate, polyamide, polypropylene, polyimide, polyamideimide, polysulfone, polyaryl ether, polyacetal, phenolic resin, acrylic resin, silicon resin, epoxy resin, urea resin, allylic resin, alkyd resin, butyral resin, and the like can be mentioned.

In addition, for the method of forming the above described respective layers, the method such as vapor deposition or coating is adopted. For coating, a bar coater, a knife coater, a roller coater, an attriter, a spray, a dip coating, an electrostatic coating, powder coating, or the like are used.

In addition, the process cartridge of the present invention is preferably arranged to have charge providing means to give electric charges of a polarity opposite to the polarity of the toner at the time of the primary transfer to the toner on the intermediate transfer belt to return the toner on the intermediate transfer belt to the electrophotographic photosensitive member at the contact part between the intermediate transfer belt and the electrophotographic photosensitive member to clean the intermediate transfer belt.

As means to electrify the toner to the opposite polarity, a blade charger and a corona charger can be used.

The toner thus returned to the electrophotographic photosensitive member from the intermediate transfer belt is removed with the electrophotographic photosensitive member cleaning means such as a cleaning blade.

This intermediate transfer belt cleaning system gives rise to a significant effect in miniaturization and cost reduction of the process cartridge compared with a system with cleaning blades, etc. being provided in the electrophotographic photosensitive member and the intermediate transfer belt, respectively, and with feeding mechanism and a container for waste toner being provided.

In addition, for the purpose of enhancing the size reduction and cost reduction (low pricing) of the intermediate transfer belt-electrophotographic photosensitive integrated process cartridges, the shape of the electrophotographic photosensitive member incorporated in the process cartridge is also important. From that viewpoint, the electrophotographic photosensitive member is preferably shaped as a drum that has a simple drive mechanism and can be easily miniaturized, and the diameter is preferably not more than 60 mm.

Moreover, enhancement in reduction of the diameter of the electrophotographic photosensitive member can reduce the area of the contact part between the intermediate transfer belt and the electrophotographic photosensitive member, or the portion where contact does not occur but at which approaching at an extremely close distance takes place, thereby gives rise to an effect to minimize the region where a problem occurs during long period storage.

In addition, the method in which the intermediate transfer belt is placed over two rollers can enhance reduction in the number of components and miniaturization can be accelerated.

Among the rollers over which the intermediate transfer belt is placed, the roller for applying tension onto the intermediate transfer belt (tension roller) may preferably slide at least 1 mm or more in the elongating direction of the intermediate transfer belt in order to correspond with elongation of the intermediate transfer belt, and in order that the intermediate transfer belt is certainly driven without slipping, the intermediate transfer belt is preferably placed over the rollers with a force of 5 N or more.

In addition, making the process cartridge separable to an electrophotographic photosensitive member unit having the electrophotographic photosensitive member and an intermediate transfer belt unit having the intermediate transfer belt, and providing connecting means to connect the electrophotographic photosensitive member unit and the intermediate transfer belt unit, a user will be able to remove the process cartridge from the main body of the electrophotographic apparatus and thereafter split the removed process cartridge into the electrophotographic photosensitive member unit and the intermediate transfer belt unit and replace only the unit having reached its end of life and the cost bearing of the user can be alleviated.

In addition, from the viewpoint of obtaining a good image, the range of volume resistivity of the intermediate transfer belt is preferably $1\times10^{6}$ to $8\times10^{13}$ Ω·cm. With the volume resistivity being less than $1\times10^{6}$ Ω·cm, the resistance is too low to give a sufficient transfer electric field and may give rise to lack of images and rough images. On the other hand, with the volume resistivity being higher than $8\times10^{13}$ Ω·cm, the transfer voltage needs to be set high, and the power supply may be enlarged or a cost increase may be introduced.

In addition, the wall thickness of the intermediate transfer belt is preferably 40 to 300 μm. With less than 40 μm, the intermediate transfer belt may lack in form stability to tend to give rise to unevenness in thickness, and its enduring intensity is insufficient, and therefore, breaking or a crack may occur. On the other hand, with more than 300 μm, the quantity of materials used increases, making costs higher, affecting the peripheral speed balance between the interior face and the exterior face of the intermediate transfer belt in the roller portion over which the intermediate transfer belt is placed, and thus such a problem as image scattering due to elongation/contraction of the exterior face is apt to occur. Also, such a problem that the intermediate transfer belt may exhibit a decreased bending endurance and become more rigid so that the driving torque may increase and the main body of the electrophotographic apparatus may be enlarged or a cost increase may be introduced is brought about.

The process cartridge of the present invention is set to be the process cartridge integrally supporting the intermediate transfer belt and the electrophotographic photosensitive member in one body, but it goes well if they are in one body at the time when a user uses them, and considering the handling of them during the production process and simplicity in dismantling thereof after collection, for example, a design that enables separation into several units, such as the intermediate transfer belt unit and the electrophotographic photosensitive member unit, is preferably adopted.

The method of forming the intermediate, transfer belt may be a method of producing seamless belts. As the producing method, a method that features high manufacturing efficiency and can control costs is preferable.

As such a method, such a method that executes continuous melt extrusion from a circular die and thereafter cuts the extruded product into a form with a necessary length to produce a belt can be mentioned. For example, inflation molding is suitable.

A preferable example of a method for producing the intermediate transfer belt of the present invention will be described below.

Figure 3:
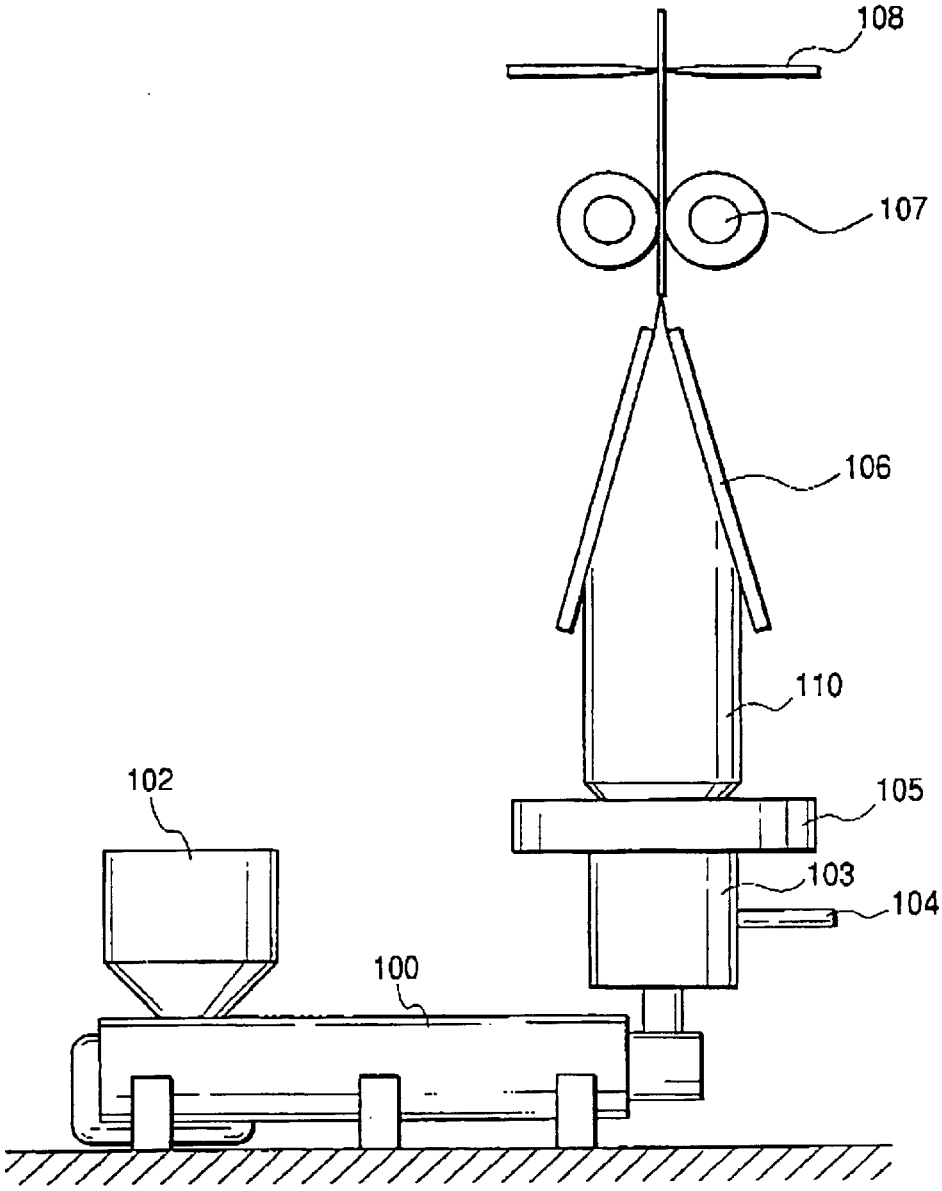
FIG. 3 is a schematic constructural view for an apparatus of forming an intermediate transfer belt (single layer) of the present invention.

An apparatus for forming the intermediate transfer belts of the present invention is schematically shown in FIG. 3. The present apparatus basically comprises an extruder, an extruder die and a gas blowing unit.

Firstly, an extrusion resin, a conducting agent, and additives, etc., are preliminarily mixed in advance in accordance with a desired formulation and thereafter kneaded and dispersed to prepare an extrusion material, which is then put into a hopper 102 provided to an extruder 100.

The extruder 100 has a preset temperature and an extruder-screw construction, which are selected so that the extrusion material may have a melt viscosity necessary for enabling the extrusion into a belt in the subsequent steps and also the materials can uniformly be dispersed each other.

The extrusion material is melt-kneaded in the extruder 100 into a melt, which then enters the cylinder-type extruder die 103. In the cylinder-type die 103, a gas inlet passage 104 is disposed, and air is blown into the center of the cylinder-type die 103 from the gas inlet passage 104 so that the melted body having passed through the die 103 inflates while scaling up in the radius direction to be a cylinder film 110.

At this time, as the gas to be blown in, beside air, nitrogen, carbon dioxide or argon, etc., can be selected. The extruded product having thus inflated into a cylinder is drawn upward while being cooled with the external cooling ring 105.

Normally, for the inflation apparatus, a method is adapted in which the product in the tubular form is crushed from the left and the right with the stabilizing plate 106 and folded into a sheet and it is then sandwiched by a pinch roller 107 without the internal air coming out so that it is drawn at a constant speed.

Subsequently, the drawn film is cut with a cutting apparatus 108 so as to provide a cylindrical film in a desired size.

Next, heat processing involving molds is preferably implemented for various purposes of removing the migrating matter, adjusting the surface flatness, improving the size accuracy, removing a crease left in the film at the time of forming, and the like.

In particular, there is a method to use a pair of cylinder molds with different diameters made of material with a different coefficient of thermal expansion.

The coefficient of thermal expansion of the cylinder mold with small diameter (internal mold) is set to get larger than the coefficient of thermal expansion of the cylinder mold with a large diameter (external mold), and after this internal mold is covered with a molded tubular film, that internal mold is inserted into the external mold in such a fashion that the internal mold and the external mold sandwich the tubular film. The gap between the molds is given subject to calculation from the heating temperature, and the difference in the coefficient of thermal expansion between the internal mold, and the external mold and the pressure is regarded as necessary.

The molds set in order of the internal mold, the tubular film, and the external mold are heated to reach near the softening point temperature of the resin. The internal mold with a larger coefficient of thermal expansion is heated to expand larger than the external mold and a uniform pressure is applied to all over the tubular film. The temperature at this time is adjusted to reach around the softening point of the resin.

The surface of the resin film is pushed onto the inner face of the external mold subjected to toughness adjustment, the surface toughness of the surface of the resin film is adjusted to reach an optimal value, and at the same time, the matter that could cause cracks in the electrophotographic photosensitive member is evaporated or attached to the mold so as to be removed from inside the film.

Thereafter, the film is cooled and taken away from the mold to obtain a belt in which size and surface properties are controlled.

Hereafter, reinforcement members and guide members or position detecting members are attached as the need arises and accurate cutting is implemented so as to produce the intermediate transfer belt.

Figure 4:
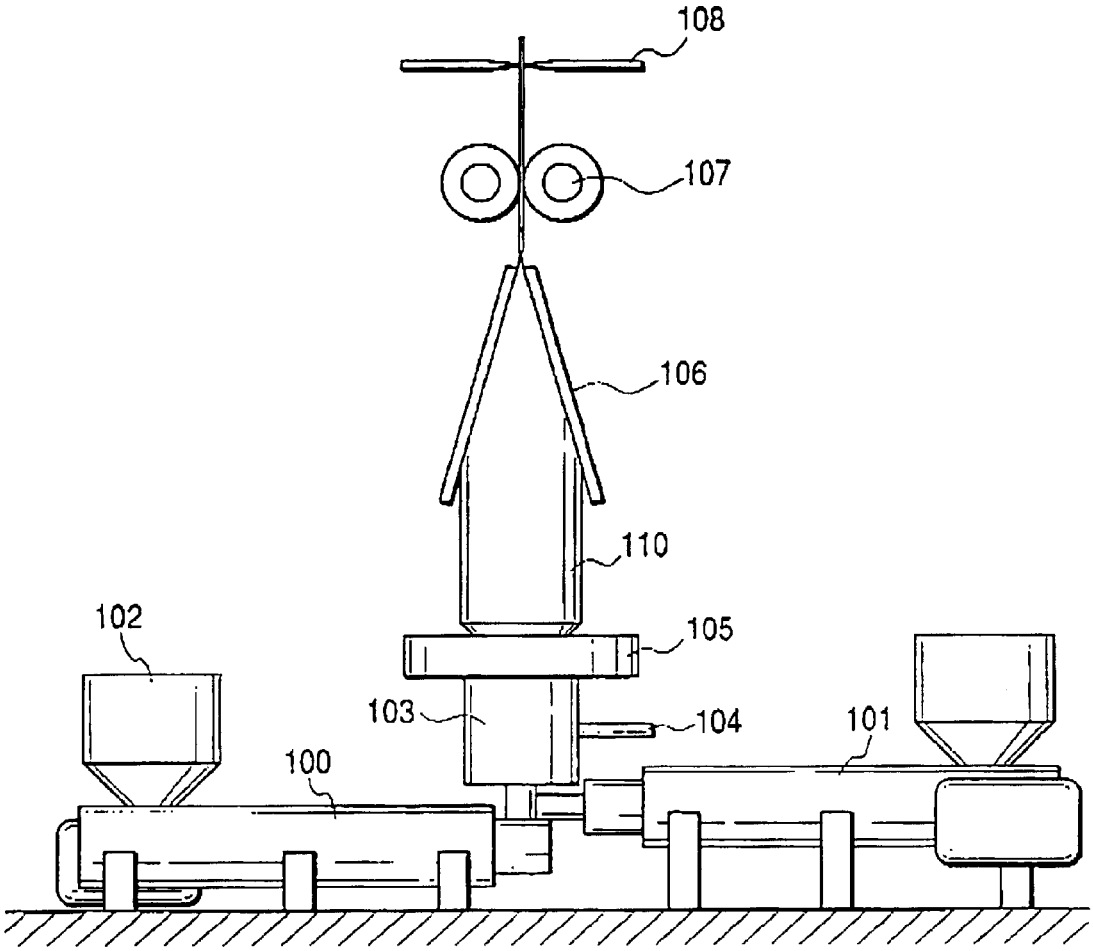
FIG. 4 is a schematic constructural view for an apparatus of forming an intermediate transfer belt (two layers) of the present invention.

In addition, the above described description relates to a single layer belt, and in case of a belt of a two-layer structure, as shown in FIG. 4, another extruder 101 is additionally disposed, simultaneously with the kneaded and melted product from the extruder 100, the kneaded and melted product from the extruder 101 is sent to the circular die 103 for two layers so that the two layers are simultaneously enlarged and expanded to obtain a two-layer belt.

Of course, for three layers and more, it goes well if extruder and circular dies are prepared in the number of layers.

Thus, intermediate transfer belts of not only of a single layer but also multi-layer construction can be formed in one step, and in a short time and with good size accuracy. The possibility of this short-time forming means that it possible to provide weight production and low-cost production.

The thickness ratio of the circular die and the formed tubular film is the ratio between the width of the gap of the circular die (die slit) and the thickness of the formed tubular film, and the latter is preferably one third or less than the former, and more preferably one fifth or less.

Likewise, the ratio of the diameter of the circular die and the formed tubular film is expressed by a percentage and comprises the ratio of the outer diameter of the tubular film 110 to the outer diameter of the die slit of the circular die 103, and preferably falls within the range of 101% to 300%.

With these express elongation states of the materials, and with thickness ratio being larger than ⅓, elongation may become insufficient so that a drop in intensity or a defect, such as unevenness in resistance and thickness, may take place. In addition, when the outer diameter exceeds 300%, thickness unevenness is apt to occur due to a drop in forming stability.

Among extrusion materials to be used for an intermediate transfer belt for use in the process cartridge of the present invention, for a resin being a main material, which is not limited in particular if it fulfills features of the present invention, olefin resin such as polyethylene and polypropylene, polystyrene resin, acrylic resin, polyester resin, polycarbonate, sulfur-containing resins such as polysulfone and polyether sulfone as well as polyphenylene sulfide, etc., fluorine resins such as polyvinylidene fluoride and polyethylene-tetrafluoroethylene copolymer, etc., polyurethane resin, silicon resin, ketone resin, polyvinylinde chloride, thermoplastic polyimide resin, polyamide resin, modified polyphenylene oxide resin and the like, various modified resins and copolymers of these can be used alone or in combination of two or more kinds of the resins. However, the present invention will not be limited to the above described materials.

Next, additives for the mixture to adjust the electric resistance value of the intermediate transfer belt to be used in the process cartridge of the present invention will not be limited in particular, and as conductive filler to adjust resistance, carbon black and various kinds of conductive metal oxides, etc., are used and as a non-filler system resistance adjusting agent, an antistatic resin containing an ether bond or a hydroxyl group, etc., in the molecule or organic high-molecular compounds showing electronic conduction are used.

Ion conducting agents with low molecular weight, such as various kinds of metallic salts and glycols, are apt to migrate or move to the electrophotographic photosensitive member, and are not preferable in general, but not all of the materials will cause problems and the materials can be used within such a range that the features of the present invention are obtainable.

Next, an example of an electrophotographic apparatus using an intermediate transfer belt-electrophotographic photosensitive member integrated process cartridge of the present invention is shown in FIG. 1.

FIG. 1 shows a full-color electrophotographic apparatus (a photocopier or a laser beam printer).

Reference numeral 1 denotes an electrophotographic photosensitive member of a rotating drum type repeatedly used as a first image bearing member, and is driven for rotation at a predetermined peripheral velocity (process speed) in the direction of an arrow.

The electrophotographic photosensitive member 1 undergoes electrical charging treatment uniformly at a predetermined polarity and potential with the (primary) charging means 2 in the course of the rotation. To the power source 32 of the electrifying means is applied a voltage formed by superimposing an alternate current onto a direct current, but only the direct current will do.

Subsequently, the photosensitive member 1 receives light 3 from an unillustrated exposing means (a color separation-image forming exposure optical system of a color image of an original, a scanning exposure system with a laser scanner outputting laser beams modulated in accordance with a time-sequential electric digital pixel signal of image information, and the like), whereby an electrostatic latent image is formed corresponding to the first color component image (for example, yellow color component image) of the desired full color image.

Next, the electrostatic latent image is developed with a first-color, such as a yellow toner Y, by use of a first developing means (yellow color developing means 41). At this time, the respective developing means of second to forth developing means (magenta color developing means 42, cyan color developing means 43 and black color developing means 44) are operated to be off so as not to act on the electrophotographic photosensitive member 1 and the first color, yellow toner image is not affected by the second to forth developing means.

The intermediate transfer belt 5 is driven for rotation at the same peripheral speed as that of the photosensitive member 1 in the direction of an arrow.

The above described first yellow toner image formed and carried on the electrophotographic photosensitive member 1 passes through the contact part between the electrophotographic photosensitive member 1 and the intermediate transfer belt 5, in the course of which it is successively primarily transferred to the external circumference face of the intermediate transfer belt 5 by the aid of an electric field formed by the primary transfer bias applied onto the intermediate transfer belt 5 from the primary transfer means 6.

The surface of the electrophotographic photosensitive member 1 having completed transfer of the first color yellow toner image to the intermediate transfer belt 5 is cleaned with the electrophotographic photosensitive member cleaning means 13.

Subsequently, likewise, the second color magenta toner image, the third color cyan toner image and the fourth color black toner image are sequentially transferred and superimposed onto the intermediate transfer belt 5, and a synthesized color toner image corresponding to the intended full color image is formed.

Reference numeral 7 denotes a secondary transfer means (secondary transfer roller) that is borne in parallel with the secondary transfer roller 8 and is disposed in the bottom face of the intermediate transfer belt 5 in a state capable of being separable therefrom.

The primary transfer bias for sequential superimposing transfer of the first to the forth toner images from the electrophotographic photosensitive member 1 to the intermediate transfer belt 5 is applied in a reverse polarity (+) to that of the toner from the bias power source 30. The voltage thus applied may be in the range of from +100V to 2 kV, for example.

In the step of primary transfer of the first to the third color toner images from the electrophotographic photosensitive member 1 to the intermediate transfer belt 5, the secondary transfer means 7 can be separated from the intermediate transfer belt 5.

For further transfer of a synthesized color toner image transferred onto the intermediate transfer belt 5 to a transfer material P, the secondary transfer means 7 is brought into contact with the intermediate transfer belt 5, and the transfer material P is fed to the contact part between the intermediate transfer belt 5 and the secondary transfer means 7 at a predetermined timing from a paper feeding roller 11 through a transfer material guide 10 and a secondary transfer bias is applied to the secondary transfer means 7 from the source 31. With the aid of this secondary transfer bias, a synthesized color toner image is secondarily transferred from the intermediate transfer belt 5 to the transfer material P.

The transfer material P having received the transfer of the toner images is then introduced into the fixing means 15 to undergo heat fixing.

After completion of the transfer of the toner images onto the transfer material P, electric charge providing means (charge providing roller) 9 is brought into contact with the intermediate transfer belt 5, where the charge providing means is disposed freely in a separate/contact state relative to the charge providing means, and a bias with a reverse polarity to that of the electrophotographic photosensitive member 1 is applied so that electric charges with a reverse polarity to that at the time of the primary transfer are given to the toners not transferred to transfer material P and remaining on the intermediate transfer belt 5 (i.e., transfer residual toners). To the bias power source 33 is applied a voltage formed by superimposing a direct current voltage on an alternating current voltage.

The transfer residual toners charged to a reverse polarity to that at the time of the primary transfer are electrostatically transferred to the electrophotographic photosensitive member 1 at the contact part of the intermediate transfer member with the electrophotographic photosensitive member 1 as well as in the vicinity thereof so that the intermediate transfer member is cleaned. Since this step can be implemented simultaneously with the primary transfer, reduction in throughput does not occur.

This intermediate transfer belt cleaning system will work only by addition of a charge providing member for giving electric charges to the transfer residual toner (electric charge providing means), and compared with the case where cleaning means and a waste toner box are separately installed on the intermediate transfer belt, miniaturization as well as cost reduction of the electrophotographic apparatus can be achieved.

Moreover, since all of the waste toner gets together to the waste toner container that is attached to the electrophotographic photosensitive member, the waste toner container is also replaced when the process cartridge is replaced, and another waste toner box is not needed to be replaced, improving maintenance performance.

However, in this intermediate transfer belt cleaning system, two kinds of steps of the primary transfer step and returning of the transferring residual toner to the electrophotographic photosensitive member are carried out simultaneously, and therefore, at the time when there is difference in sensitivity or minute cracks on the surface in the electrophotographic photosensitive member, the image undergoing primary transfer is apt to be affected.

Accordingly, in case of adopting this intermediate transfer belt cleaning system, it is important in particular for the intermediate transferring member and the electrophotographic photosensitive member to satisfy the above described features of the present invention. In other words, this intermediate transfer belt cleaning system activates the present invention and is preferable.

Next, an example of an intermediate transfer belt-electrophotographic photosensitive member integrated process cartridge of the present invention will be described.

Figure 2:
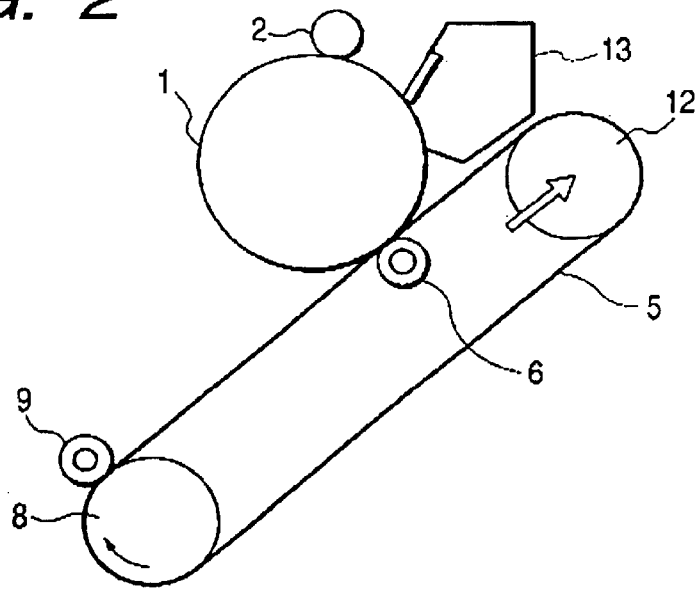
FIG. 2 is a schematic view of an intermediate transfer belt-electrophotographic photosensitive member integrated process cartridge of the present invention.

The process cartridge of the present invention shown in FIG. 2 is constructed as a one-body unit comprising an intermediate transfer belt 5, an electrophotographic photosensitive member 1, charge providing means 9, electrophotographic photosensitive member cleaning means 13, and roller-shape primary transfer means 6 to be housed in a not-shown frame and to be made easily detachably mountable to the main body of the electrophotographic apparatus.

In addition, the process cartridge shown in FIG. 2 comprises a mechanism to charge the transfer residual toner to a polarity opposite to that of the primary transfer as mentioned above, and to return the toner to the electrophotographic photosensitive member in the primary transfer part, that is, in the present drawing, roller-shape charge providing means (electric charge providing roller) 9 made of elastic member with medium resistance.

In this drawing, as the electrophotographic photosensitive member cleaning means, a cleaning blade is adopted.

In this process cartridge, a not-shown waste toner container is also integrated, the transfer residual toner on both of the intermediate transfer belt and the electrophotographic photosensitive member is discarded at the same time when the cartridge is replaced and contributes to improvement in maintenance performance.

In addition, the intermediate transfer belt is placed over and around two rollers 8 and 12 so that a reduction in the number of components and miniaturization are achieved. Here, a driving roller 8 serves at the same time as a facing roller to the electric charge providing roller as well as a secondary transfer facing roller.

A tension roller 12 that rotates following the intermediate transfer belt has a sliding mechanism and is brought into press contact in the direction of an arrow with a compressing spring to give tension to the intermediate transfer belt. The slide width thereof is about 1 to 5 mm and the total pressure of the spring is around 5 to 100 N.

In addition, the electrophotographic photosensitive member 1 and the driving roller 8 have a not-shown coupling so that the rotation drive force is transmitted from the main body.

A measuring method on respective properties related to the present invention will be shown below.

Figure 5:
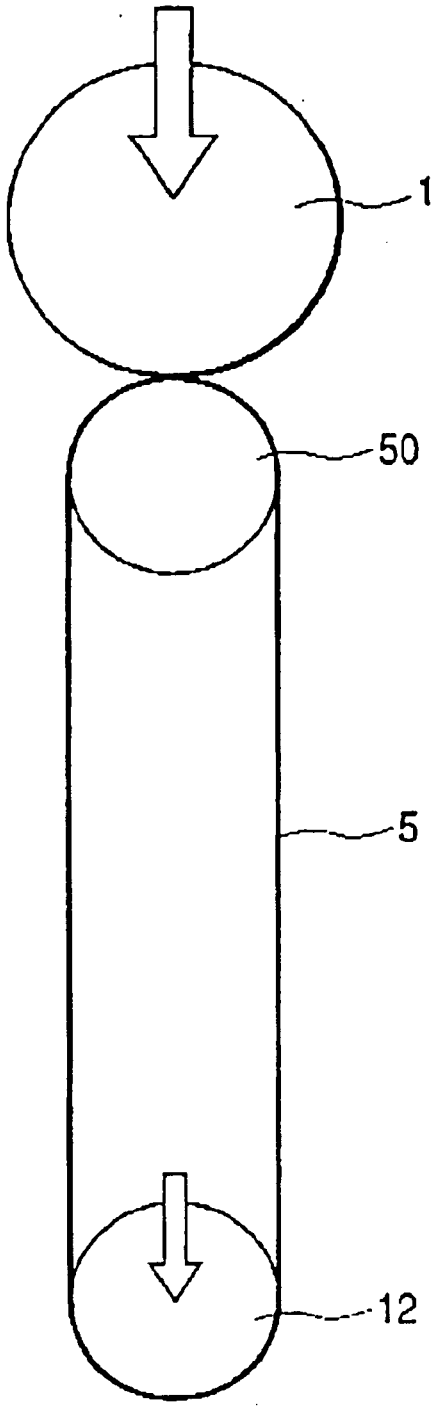
FIG. 5 is a schematic drawing showing a method of testing contact between an intermediate transfer belt and the electrophotographic photosensitive member.

Method of Testing Contact Between Intermediate Transfer Belt and Electrophotographic Photosensitive Member As shown in FIG. 5, an intermediate transfer belt 5 is placed over and around a rubber roller 12 with a diameter of 30 mm which is prepared by winding rubber (the one which has already been confirmed not to influence to the intermediate transfer belt) with a thickness of 5 mm and JIS hardness of 45° around an aluminum cylinder having a diameter of 20 mm. Reference numeral 50 denotes a roller facing the electrophotographic photosensitive member.

Reference numeral 12 denotes a tension roller onto which a force of 20 N is applied in the direction of the arrow.

The electrophotographic photosensitive member 1 is brought into contact with the intermediate transfer belt with a force of linear pressure of 0.5 N/cm±5%. The contacting portion is marked in advance both in the intermediate transfer belt and the electrophotographic photosensitive member.

Here, the linear pressure is a numerical value given by the force applied to the electrophotographic photosensitive member being divided by length (cm) in the direction of a shaft where the intermediate transfer belt and the electrophotographic photosensitive member are brought into contact, and with the contact length being 30 cm and the linear pressure being 0.5 N, a total pressure of 15 N will become necessary.

Moreover, this test apparatus is housed in a not-shown least size box and is completely shaded and volatile matter appearing inside the box will not be arranged not to diffuse easily. However, the box is designed not to be sealed completely but to have the same humidity as that of the measuring environment.

This apparatus is placed in an environment of high temperature and high humidity set at 45° C./95% RH and calmly put for the necessary time (10 hours or 336 hours).

Method of Observing the Surfaces of Intermediate Transfer Belt and Electrophotographic Photosensitive Member Three portions of contacting parts which are marked in the intermediate transfer belt and the electrophotographic photosensitive member subjected to a leaving test and two portions of non-contacting portions in the vicinity of the contacting part arc cut out in a size of 10 mm×10 mm and the existence of cracks is confirmed by magnifying with a Scanning Electron Microscope (SEM). In the case where there is any crack, the size thereof is measured.

Light Portion Potential-dark Portion Potential Measuring Method

Figure 6:
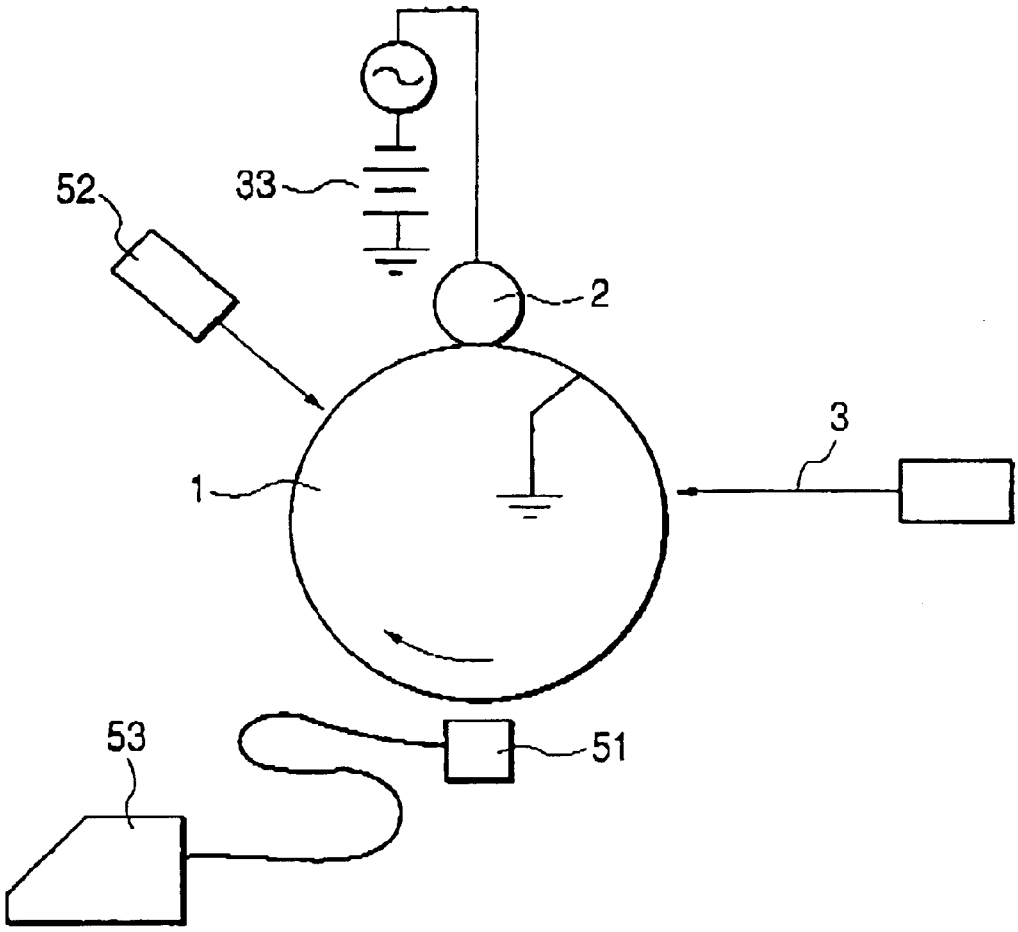
FIG. 6 is a schematic drawing showing a method of measuring the light portion potential and the dark portion potential of an electrophotographic photosensitive member.

The electrophotographic photosensitive member having undergone the contact test is set to an apparatus shown in FIG. 6.

The electrophotographic photosensitive member 1 is caused to rotate in the direction of the arrow with a not-shown motor and is charged uniformly with a charging unit 2. In the present test apparatus, a power source 33 in which direct currents are superimposed onto alternate currents is used. Reference numeral 3 denotes exposing light, reference numeral 51 denotes a surface potentiometer which is arranged to be able to record surface potentials continuously with a recording apparatus 53. Reference numeral 52 denotes a pre-exposing means, which erase electric charges with intensive exposing prior to charging.

As for measuring of the dark portion potential, the electrophotographic photosensitive member 1 is caused to rotate at a peripheral speed of 120 mm/s, and without the use of exposing light 3 but with pre-exposing means 52 being used, the voltage of the charging unit 2 is adjusted so that the surface potential of the non-contacting portion is approximately −600V.

Changes in the surface potential of the electrophotographic photosensitive member at this time are recorded with the recording apparatus 53 to cover five rotations of the electrophotographic photosensitive member at an interval of 0.002 second.

Next, all the measured values are averaged.

Next, a numerical value with the largest difference from the average value in the previously marked portion contacting with the intermediate transferring member is extracted for each rotation, and the average over five rotations is obtained. From these values, the potential change amount (%) is obtained with the following equation:

(Contact Part Potential Average Value-total Potential Average Value)/total Potential Average Value×100(%)

As for measuring of the light portion potential, the emitting intensity of the exposing light 3 is adjusted so that the surface potential will be −150V. Changes of potential are then recorded in the same manner as in the dark portion potential and calculated.

This value, which falls within the region of not more than ±20%, can be said to fall within the range of the present invention.

A description is provided with reference to negative charging, but the charging polarity as well as the exposing wavelength is appropriately selected in accordance with the kinds of the electrophotographic photosensitive member.

Volume Resistance Measuring Method

As for the measuring apparatus, a Super high resistance meter R8340A (produced by Advantest) is used as resistance meter, and as for the test sample box, a test sample box for a super high resistance meter TR42 (produced by Advantest) is used, but the main electrode is set to have a diameter of 25 mm while the guard ring electrode is set to have an inner diameter of 41 mm and an outer diameter of 49 mm.

Samples are produced as follows.

At first, the intermediate transfer belt is cut out into a disk of diameter of 56 mm with a puncher or a sharp knife.

One face of the disk piece cut out is provided with an electrode all over its face with a Pt-Pd vapor-deposition film, and the other face is provided with a main electrode having a diameter of 25 mm and a guard electrode having an inner diameter of 38 mm and an outer diameter of 50 mm with Pt-Pd vapor-deposition film.

The Pt-Pd vapor-deposition film is obtained by carrying out the deposition operation for two minutes with the mild sputter E1030 (produced by Hitachi, Ltd.).

Those that completed the deposition operation are treated as measuring samples.

The measuring atmosphere is set to be 23° C./55% RH and the measuring samples are in advance left to stand in the above described measuring atmosphere for not less than 12 hours.

As for measuring, discharge lasts for 10 seconds, charging lasts for 30 seconds and measuring lasts for 30 seconds, and measuring is carrying out with the application voltage of 100 V.

Thickness Measuring Method

As for the thickness unevenness of the intermediate transfer belt, it was measured in the dial gauge at a minimum value of 1 mm at 50 mm from both ends of the belt, and at four points at an equal interval in the center in the periphery direction all over the circumference, and 12 points in total were averaged for one intermediate transfer belt.

The present invention will be described in further detail below by the following Examples.

In the Examples, "part(s)" is part(s) by weight.

EXAMPLE 1

Method of Producing an Electrophotographic Photosensitive Member

An aluminum cylinder of diameter of 47 mm and length of 270 mm was provided with a conductive layer of film thickness of 20 mm made of conductive metal oxide and phenol resin by way of dipping coating.

Thereafter the intermediate layer of film thickness of 1 mm made of methoxymethylated nylon was applied on the above described conductive layer, and moreover, a charge generation layer of film thickness of 0.05 mm containing gallium phthalocyanine as charge generation material was formed thereon by way of dipping coating.

Next, a charge transport layer of film thickness of 20 mm made of 0.9 parts of charge transporting material having the structure shown in the following formula (1), (1)

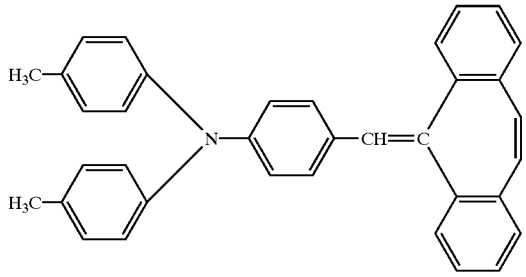

8.1 parts of charge transporting material having the structure shown in the following formula (2)

(2)

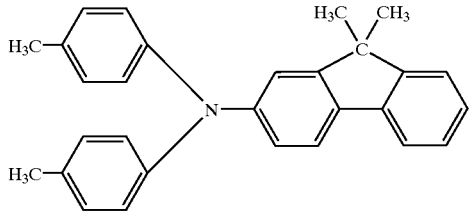

and 10 parts of the polyarylate resin was provided on the above described charge generation layer also by way of dipping coating so that an electrophotographic photosensitive member 1 of rigid drum shape of diameter of approximately 47 mm.

Manufacturing Method of Intermediate Transfer Belt

An intermediate transfer belt was manufactured with the following materials.

| | |
|---|---|
| Polyvinylidene fluoride resin (PVDF) | 100 parts |
| Polyetheresteramide (Pelestat NC6321: Produced by Sanyo Chemical Industries, Ltd.) | 11 parts |
| Zinc oxide | 25 parts |

These materials were melt-kneaded at 210° C. by means of a twin-screw extruder with a decompressor inside the cylinder, and at the same time the volatile components were removed under a reduced pressure.

Thereafter, the mixture obtained was extruded in the shape of a strand, having a diameter of about 2 mm, followed by cutting into pellets. This was regarded as a molding raw material (extrusion material) 1.

The above described molding raw material 1 was constructed to use polyetheresteramide being a resistance adjusting agent of high molecular weight hardly giving rise to movement (relocation) of matter for fulfilling the above described features of the present invention and moreover to add zinc oxide as a non-active inorganic powder so that the contact area with the electrophotographic photosensitive member is reduced.

Next, in the molding apparatus shown in FIG. 3, the molding die 103 was a circular die for a single layer with diameter of 100 mm and the slit was set to 0.8 mm.

The molding raw material 1 having been well dried by heating, was put into a material hopper 102 of this molding apparatus, and heated and melted. The molten product was extruded into a cylinder shape at 210° C. from the die.

An external cooling ring 105 is disposed around the die, and air was blown from the circumference onto the extruded film to effect cooling.

In addition, the air was blown into the interior of the extruded tubular film from the gas inlet passage 104 to cause the film to inflate while scaling up to have a diameter of 140 mm. Thereafter, the film was continuously drawn off at a constant speed with a draw-off unit.

At this time, the thickness of the film was adjusted to 100 mm. Incidentally, the introduction of the air was stopped at the time when the diameter reached the desired value.

Moreover, subsequent to the draw-off through the pinch rollers, the tubular film was cut with a cutter 108.

The film was cut in a length of 290 mm after the thickness was stabilized, to form a tubular film 1.

On the tubular film 1, the size and surface smoothness were regulated and folds were removed by means of a set of cylindrical molds made of metals with different thermal expansion coefficients.

At first, the tubular film 1 was placed over and around the internal mold with a higher thermal expansion coefficient.

Next, the internal mold covered with the above described film 1 was inserted into the external mold with the inner face having been processed into a smooth face followed by heating at 170° C. for 40 minutes. Also at this time, removal of the volatile components and low molecular weight components was promoted.

After cooling, the tubular film 1 was removed from the mold to cut the ends away and a meandering-preventing member made of urethane elastomer was attached to the rear face of the end to produce an intermediate transfer belt 1 with a diameter of 140 mm, a length of 250 mm and a thickness of 100 $\mu$m.

Using this intermediate transfer belt 1 and the electrophotographic photosensitive member 1, contact tests were executed with the method of the present invention.

The samples used in the contact tests consisted of three respectively for image confirmation, for surface crack confirmation and for potential confirmation as a set.

These samples were left to stand under an environment of high temperature and high humidity of 45° C./95% RH for 10 hours and 336 hours.

After the contact test was completed, the surface of one set each for the two laps was observed by means of Scanning Electron Microscope, and no crack was confirmed in the electrophotographic photosensitive member and the intermediate transfer belt in both of the samples left standing for 10 hours and the sample left standing for 336 hours.

In addition, moreover, subject to being left standing for one-day under 23° C./55% RH, the light portion potential and the dark area potential of the electrophotographic photosensitive member were measured, and no difference between the contact portion and non-contact portion was admitted, giving rise to a good result.

Figure 7:
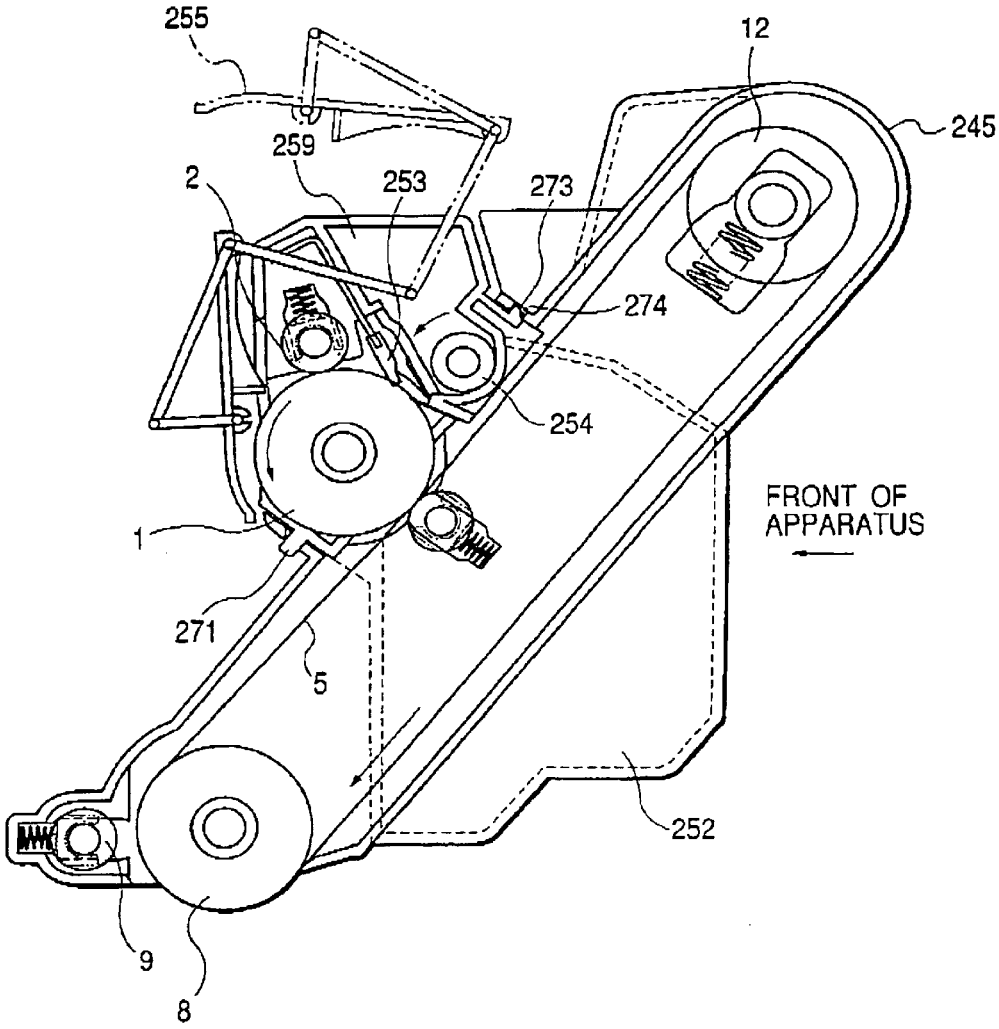
FIG. 7 is a schematic constructural view of a process cartridge constructed by connecting together an electrophotographic photosensitive member unit and an intermediate transfer belt unit used in Examples and Comparison Examples.

Likewise, subject to being left standing for one-day under 23° C./55% RH, the intermediate transfer belt and the electrophotographic photosensitive member were incorporated into an intermediate transfer belt-electrophotographic photosensitive member integrated process cartridge of a construction shown in FIG. 7. This is treated as the process cartridge of Embodiment 1.

The unit construction is roughly divided into two parts in FIG. 7.

Figure 8:
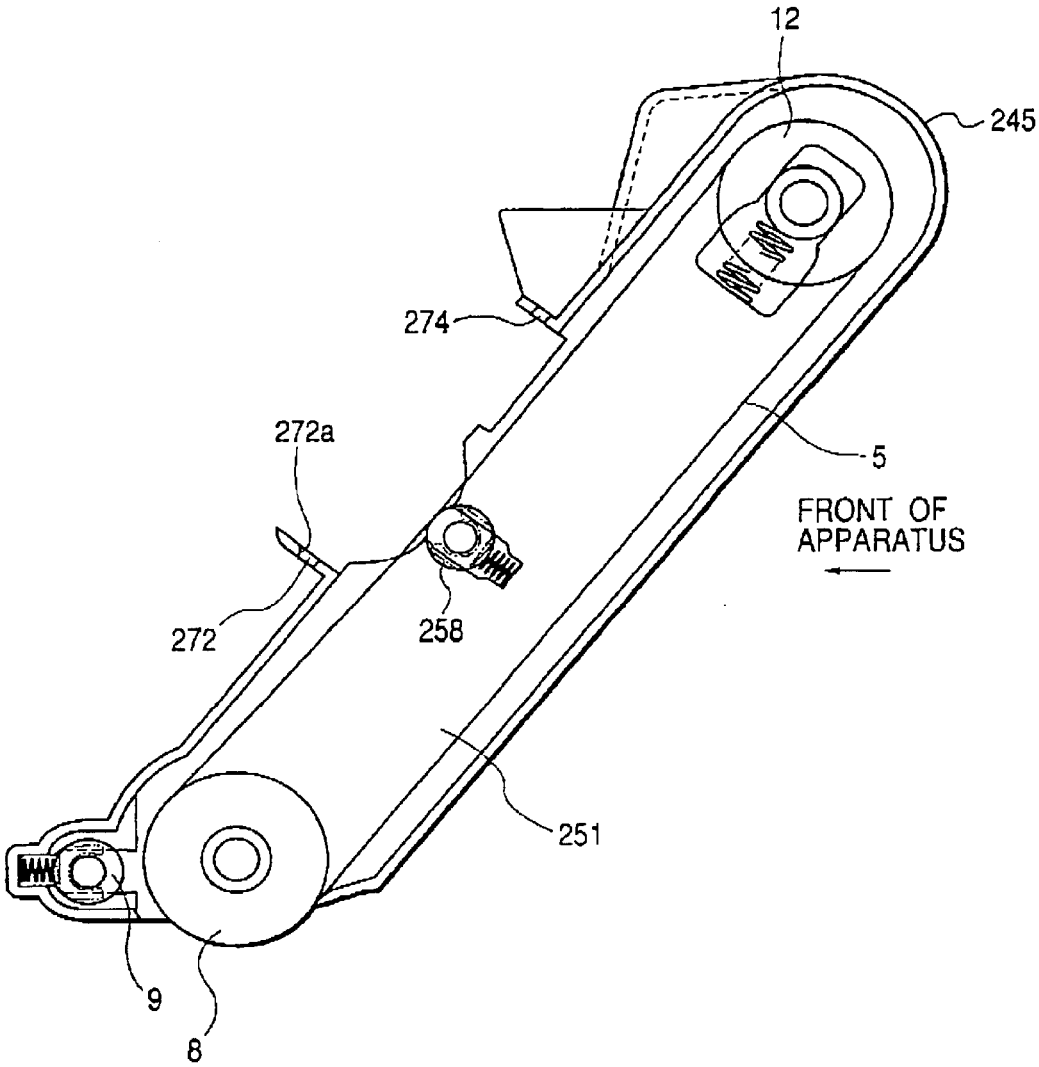
FIG. 8 is a schematic constructural view of an intermediate transfer belt unit.

One is an electrophotographic photosensitive member unit 50 shown in FIG. 8.

This is composed of as the main components in an electrophotographic photosensitive drum frame 259 as one-body together with the waste toner container 252, the electrophotographic photosensitive member 1, the charging means (charging roller) 2, the electrophotographic photosensitive member cleaning means (cleaning blade) 253, the screw 254 and the drum shutter 255.

The other is an intermediate transfer belt unit 251 shown in FIG. 8.

For this, the intermediate transfer belt 5 is placed over and around the intermediate transfer belt frame 245 with the secondary transfer facing roller 8 and a tension roller (following roller) 12, and primary transfer means (primary transfer roller) 258 disposed inside the intermediate transfer belt facing the electrophotographic photosensitive member 1 and charge providing means 9 disposed relative to the secondary transfer facing roller (drive roller) 8. Incidentally, the secondary transfer facing roller (drive roller) 8 has function as a drive roller to rotate the intermediate transfer belt 5.

As for these two units, protrusions 271 provided in the both right and left ends of the electrophotographic photosensitive member frame 259 are respectively inserted into the positioning holes 272 provided in the intermediate transfer belt frame 245, and on the other hand, a nail 273 of hook part of a snap fit form provided in the center of the width direction of the electrophotographic photosensitive member frame 259 is engaged into a lock hole 274 of the intermediate transfer frame 245 for connection.

Here, the positioning holes 272 provided in the intermediate transfer frame 245, and the lock hole 274 are provided with holes sized larger by a predetermined amount than the protrusions 271 provided in the electrophotographic photosensitive member frame 259 and the hook part nail 273, and are constructed to permit relative positional movements of a predetermined amount between the electrophotographic photosensitive member unit 250 and the intermediate transfer belt unit 251.

In addition, the positioning holes 272 are provided with taper parts 272*a* for easy attachment/detachment.

Figure 9:
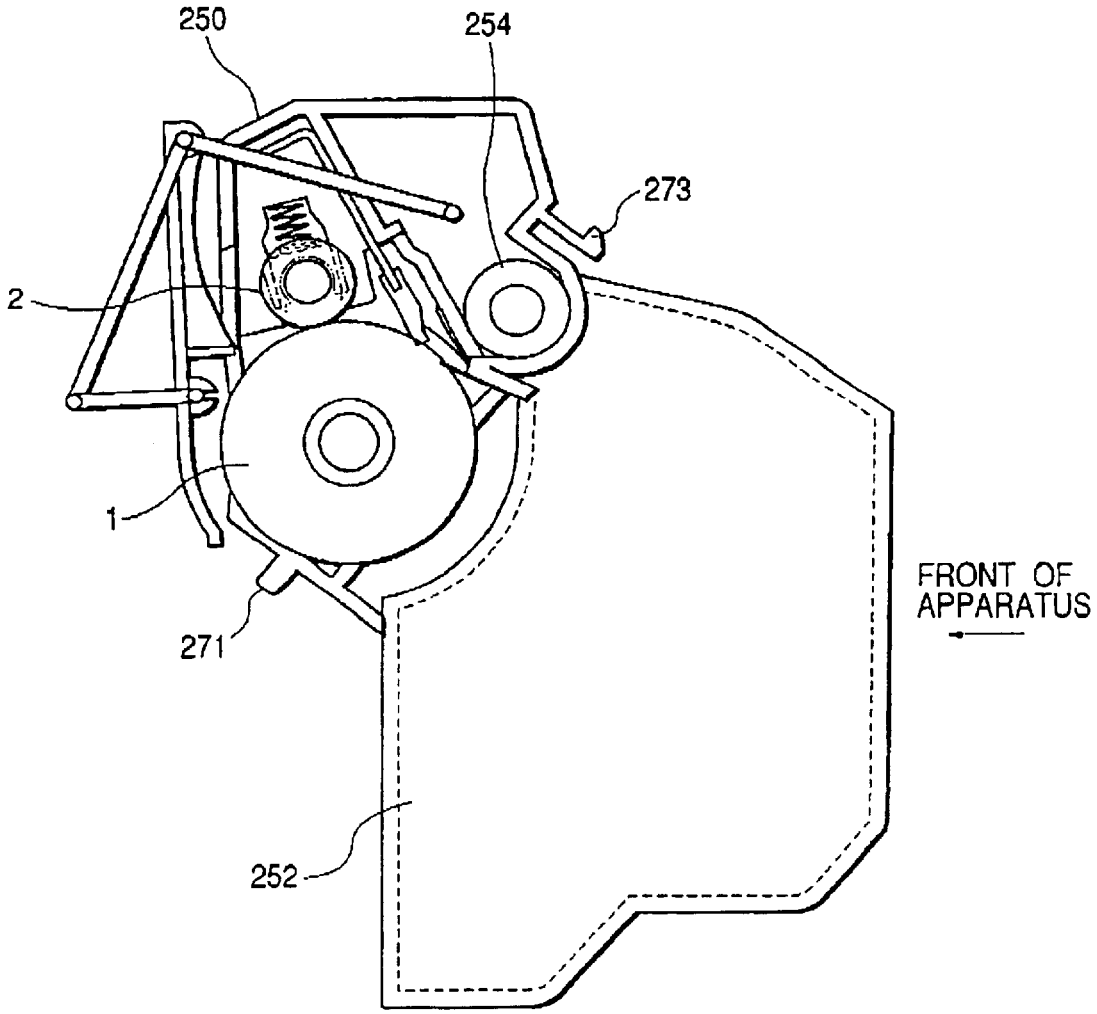
FIG. 9 is a schematic constructural view of an electrophotographic photosensitive member unit.

In FIG. 7, the hook nail 273 of the electrophotographic photosensitive member unit 250 is pushed so as to be taken off from the lock holes 274 of the intermediate transfer belt unit 251, and the electrophotographic photosensitive member unit 250 is rotated, and thus as shown in FIG. 8 and FIG. 9, division into the electrophotographic photosensitive member unit and the intermediate transfer belt unit can be executed.

At the time of connection, on the contrary to the above described, the protrusions 271 of the electrophotographic photosensitive member unit 250 are inserted into the positioning holes 272 of the intermediate transfer belt unit 251 and rotation in the opposite direction to the case of removal is implemented and the hook nail 273 is pushed into the lock hole 274 to thereby connect the two units.

Thus, adopting such a construction of dividability into an electrophotographic photosensitive member unit and an intermediate transfer belt unit and having connecting means to connect the electrophotographic photosensitive member unit and the intermediate transfer belt unit, a user will be able to remove the process cartridge from the main body of the electrophotographic apparatus and thereafter divide the removed process cartridge into the electrophotographic photosensitive member unit and the intermediate transfer belt unit and replace only the unit having reached the end of its life and the cost bearing of the user can be reduced.

The charge providing means 9 are brought into connection with a not-shown feeder plate, and when the process cartridge is incorporated into the main body of the image forming apparatus, power supply will become possible to the charge providing means 9 from the main body of the image forming apparatus through the not-shown feeder plate. This can serve to electrify the transfer residual toner on the intermediate transfer belt 5 to the opposite polarity against the photosensitive member.

After completion of image transfer onto the transfer material P, charge providing means 9 are brought into contact with the intermediate transfer belt 5 disposed freely in a separate/contact state and a bias of a reverse polarity against the electrophotographic photosensitive member 1 is applied so that charges of reverse polarity against the primary transfer are given to the transfer residual toner remaining on the intermediate transfer belt 5 without being transferred onto the transfer material P. Here, direct currents with alternating currents were applied by being superposed.

The above described transfer residual toners electrified to a polarity opposite to that at the time of the primary transfer are electrostatically transferred to the electrophotographic photosensitive member 1 at the contact part of the intermediate transfer member with the electrophotographic photosensitive member 1 as well as in the vicinity thereof so that the intermediate transfer member is cleaned. Since this step can be implemented simultaneously with the primary transfer, reduction in throughput does not occur.

The spring pressure of the tension roller (following roller) was 20 N totaling the right and the left parties with the slide amount of 2.5 mm and the diameter of the tension roller (following roller) and the secondary transfer facing roller (drive roller) was 28 mm for use.

This intermediate transfer belt-electrophotographic photosensitive member integrated process cartridge was disposed in the electrophotographic apparatus shown in FIG. 1, and a full color image print test was carried out to 80 g/m$^2$ paper under the same environment.

The developing apparatus used at this occasion was set to adopt a 600 dpi digital laser system.

The obtained image was evaluated visually, giving rise to a good full color image without any problem such as color unevenness as well as faulty transfer.

In addition, the intermediate transfer belt 1 was brought into resistance measuring with the test method of the present invention, resulting in the volume resistance value (volume resistivity) being $9.8\times10^{11}$ Ω·cm.

In addition, moreover as the final test, a transportation test of the process cartridge of Example 1 was carried out.

The test method was to transport a not yet used process cartridge between Tokyo and Sydney by sea, and thereafter by airmail on the way back so as to confirm the existence of the occurrence of problems at the time of transportation in a high temperature and high humidity environment on a ship and transportation by air being simultaneously executed.

After transportation, the collected process cartridge underwent a likewise print test as described above, an image without any problem was obtained as well, proving its performance without any problems even after long-term transportation.

Evaluation results are shown in Table 1 and Table 2.

EXAMPLE 2

An intermediate transfer belt 2 was produced in the same manner as in Example 1 except that composition ratio was changed as follows.

| | |
|---|---|
| Polyvinylidene fluoride resin (PVDF) | 100 parts |
| Polyetheresteramide (Pelestat NC6321: Produced by Sanyo Chemical Industries, Ltd.) | 8 parts |
| Perfluorobutane sulfonic acid potassium | 2 parts |
| Zinc oxide | 25 parts |

Perfluorobutane sulfonic acid potassium was featured by its aptness not to be deposited on the surface of the intermediate transfer belt under high temperature and high humidity with low water solubility in salts and its compatibility with polyvinyliden fluoride resin (PVDF) because of containing fluorine.

On the intermediate transfer belt 2, measurement of its properties were performed so that, an image print test and a transportation test were carried out in the same manner as in Example 1. The results thereof were as good as in Example 1.

Evaluation results are shown in Table 1 and Table 2.

EXAMPLE 3

The composition ratio was changed as follows, and in accordance with the resin, mixing as well as molding and mold heating temperature were raised to 260° C. In addition, in molding processing, inner coarseness on the face of the outer mold was changed to become slightly coarse. Otherwise, an intermediate transfer belt 3 was produced in the same manner as Example 1.

| | |
|---|---|
| Polycarbonate A | 100 parts |
| Conductive carbon black | 25 parts |

The conductive agent in the present example is carbon black, being featured by exclusion of organic matter of low molecular weight badly affecting in particular the electrophotographic photosensitive member.

On the intermediate transfer belt 3, measurement of its properties were performed so that an image print test and a transportation test were carried out in the same manner as in Example 1. The results thereof were as good as in Example 1.

Evaluation results are shown in Table 1 and Table 2.

EXAMPLE 4

An electrophotographic photosensitive member 2 was produced in the same manner as in Example 1 except that polycarbonate Z was used instead of polyarylate. Except that this electrophotographic photosensitive member 2 was used, measurement of its properties were performed so that an image print test and a transportation test were carried out in the same manner as in Example 1. The results thereof were as good as in Example 1.

Evaluation results are shown in Table 1 and Table 2.

COMPARATIVE EXAMPLE 1

A comparative intermediate transfer belt 1 was produced in the same manner as in Example 1 except that composition ratio was changed as follows.

| | |
|---|---|
| Polyvinylidene fluoride resin (PVDF) | 100 parts |
| Polyetheresteramide (Pelestat NC6321: Produced by Sanyo Chemical Industries, Ltd.) | 20 parts |
| Perfluorobutane sulfonic acid | 4 parts |
| Dioctyl phthalate (plastic agent) | 1 part |

On the comparative intermediate transfer belt 1, tests as in Example 1 and the image print test were carried out. As the result, a small number of cracks of length of 0.5 to 0.8 $\mu$m occurred on the electrophotographic photosensitive member which underwent the contact test for 10 hours, and moreover, a number of cracks of length of 30 to 150 $\mu$m were discovered on the electrophotographic photosensitive member which underwent the contact test for 336 hours.

In addition, the potential of the electrophotographic photosensitive member which underwent the contact test for 10 hours was measured. As the result, the light portion potential in the portion that was contacting with the intermediate transfer belt was higher than the neighborhood by 21%, and on the contrary, the dark portion potential of the contacting portion was lower by 15%. Moreover, as for the potential of the portion, that was contacting the intermediate transfer belt, of the electrophotographic photosensitive member which underwent the contact test for 336 hours, the light portion potential was higher by 32% and the dark portion potential was lower than the neighborhood by 21%.

The image was confirmed with the method of Example 1 by using this intermediate transfer belt and the electrophotographic photosensitive member.

As for the electrophotographic photosensitive member left standing for 10 hours, image density becomes higher in the portion corresponding to the contact part with the intermediate transfer belt in a half tone image or a white image, and as for the electrophotographic photosensitive member left standing for 336 hours, more remarkable streaks of high density occurred on a half tone or a solid white image, and for a high density image, on the contrary, thin color streaks occurred.

Moreover, also a process cartridge that underwent the transportation test gave rise to streaks of high density occurred on a half tone or a white image, and was found out not to be able to endure a long-period transportation.

Evaluation results are shown in Table 1 and Table 2.

COMPARATIVE EXAMPLE 2

The composition ratio of the intermediate transfer belt was changed as follows, and after respective materials were mixed well and were poured into centrifugal molding mold and were rotated while the solvent was evaporated and underwent urethane forming reaction, and thereby a belt made of urethane elastomer of diameter of 140 mm and thickness of 500 $\mu$m by way of centrifugal molding method, and subject to end cutting as well as with a meandering-preventing rib being stuck, a comparative intermediate transfer belt 2 was produced.

| | |
|---|---|
| Polyester polyol (synthesized from adipic acid and butylenes glycol) | 100 parts |
| Isocyanate (tolylene diisocynanate (TDI)) | 20 parts |
| Conductive carbon black | 20 parts |
| Methyl isobutyl ketone (solvent) | 100 parts |

On the comparative intermediate transfer belt 2, measurement of properties as in Example 1 and the image print test were carried out. As the result a number of cracks of 3 to 12 μm were discovered in the portion where the electrophotographic photosensitive member, which underwent the contact leaving test for 10 hours, and the intermediate transfer belt were brought into contact.

Moreover, it was supposed that the electrophotographic photosensitive member left standing for 336 hours has a number of cracks of 500 to 800 mm in the intermediate transfer belt contact part, and since a small number of cracks of length about 15 to 30 mm occurred also in the vicinity of the intermediate transfer belt contact part, even the portion where no direct contact takes place is also influenced by the evaporated components such as solvent.

In addition, as for the potential difference between the portion where this electrophotographic photosensitive member contacts the intermediate transfer belt and the circumference, there is no significant difference in the dark portion potential after leaving it to stand for 10 hours, +8% in the light portion potential, and +18% in the light portion potential after leaving it for 336 hours.

As for the image print test, in the electrophotographic photosensitive member left standing for 10 hours, there are streak-like portions with high image density in the half tone image corresponding with the intermediate transfer belt contact part, and moreover, blur of characters and fine lines occurred in the contact part and in the vicinity thereof.

The one after leaving it to stand for 336 hours gave rise to more remarkable image defects.

Moreover, the process cartridge subject to the transportation test also gave rise to such a phenomenon as described above, and was found out to be unable to endure long-period transportation.

Evaluation results are shown in table 1 and table 2.

TABLE 1

| | crack (μm) | | | | | | | |
|---|---|---|---|---|---|---|---|---|
| | 10 hours | | | | 336 hours | | | |
| | electrophotographic photosensitive member | | intermediate transfer belt | | electrophotographic photosensitive member | | intermediate transfer belt | |
| | contact part | vicinity of contact part | contact part | vicinity of contact part | contact part | vicinity of contact part | contact part | vicinity of contact part |
| Example 1 | none | none | none | none | none | none | none | none |
| Example 2 | none | none | none | none | none | none | none | none |
| Example 3 | none | none | none | none | none | none | none | none |
| Example 4 | none | none | none | none | none | none | none | none |
| Comparative Example 1 | 0.5–0.8 | none | none | none | 30–150 | none | none | none |
| Comparative Example 2 | 3–12 | none | none | none | 500–800 | 15–30 | none | none |

TABLE 2

| | potential of electrophotographic photosensitive member in the contact part | | | | | | intermediate transfer belt resistance | image evaluation after transportation test |
|---|---|---|---|---|---|---|---|---|
| | 10 hours | | 336 hours | | image evaluation | | | |
| | dark portion potential (%) | light portion potential (%) | dark portion potential (%) | light portion potential (%) | 10 hours | 336 hours | (Ω·cm) | |
| Embodiment 1 | 0 | 0 | 0 | 0 | good | good | $9.80 \times 10^{11}$ | good |
| Embodiment 2 | 0 | 0 | 0 | 0 | good | good | $1.20 \times 10^{11}$ | good |
| Embodiment 3 | 0 | 0 | 0 | 0 | good | good | $8.50 \times 10^{8}$ | good |
| Embodiment 4 | 0 | 0 | 0 | 0 | good | good | $9.80 \times 10^{11}$ | good |
| Comparative Example 1 | −15 | +21 | −21 | +32 | streak-like image defect | streak-like image defect | $9.00 \times 10^{9}$ | streak-like image defect |
| Comparative Example 2 | 0 | +8 | 0 | +18 | streak-like image defect-blur | streak-like image defect-blur | $9.50 \times 10^{5}$ | streak-like image defect-blur |

According to the present invention, a process cartridge that makes maintenance easy, can plan miniaturization as well as cost reduction of the apparatus to/from which it is attached/removed and makes good images available and an electrophotographic apparatus having the process cartridge can be provided.

What is claimed is:

1. A process cartridge which is detachably mountable to a main body of an electrophotographic apparatus, integrally comprising:

an electrophotographic photosensitive member configured to carry a toner image;

an intermediate transfer belt having a contact part configured and positioned to contact said electrophotographic photosensitive member, primary transfer means for primarily transferring the toner image at said contact part from said electrophotographic photosensitive member to said intermediate transfer belt; and charge providing means for providing electric charges having a polarity opposite to the polarity of the toner at the time of said primary transfer of the toner image to said intermediate transfer belt to return the toner on said intermediate transfer belt to said electrophotographic photosensitive member at said contact part to clean said intermediate transfer belt, wherein said electrophotographic photosensitive member and said intermediate transfer belt are respectively configured so that the difference between the light portion potential at said contact part and the light portion potential at a non-contact portion of said electrophotographic photosensitive member that does not contact said intermediate transfer belt, and the difference between the dark portion potential at said contact part and the dark portion potential at said non-contact portion, are respectively less than 20%, and no crack having a length of not less than 1 μm occurs in any of the surface of said electrophotographic photosensitive member and the surface of said intermediate transfer belt, when said electrophotographic photosensitive member and said intermediate transfer belt are brought into contact with each other under a linear pressure of 0.5 N/cm and left to stand for 10 hours in an environment of 45° C./95% RH.

2. The process cartridge according to claim 1, wherein said electrophotographic photosensitive member comprises secondary transfer means for further transferring to a transfer material the toner image having been primarily transferred to said intermediate transfer belt from said electrophotographic photosensitive member.

3. The process cartridge according to claim 1, further comprising integral electrophotographic photosensitive member cleaning means for cleaning said electrophotographic photosensitive member.

4. The process cartridge according to claim 3, wherein said integral electrophotographic photosensitive member cleaning means is blade cleaning means comprising an elastic blade.

5. The process cartridge according to claim 1, wherein said process cartridge is separable into an electrophotographic photosensitive member unit having said electrophotographic photosensitive member and an intermediate transfer belt unit having said intermediate transfer belt, and further comprises connecting means for connecting said electrophotographic photosensitive member unit and said intermediate transfer belt unit.

6. The process cartridge according to claim 1, wherein said electrophotographic photosensitive member and said intermediate transfer belt are respectively configured so that the difference between the light portion potential at the contact part and the light portion potential at the non-contact portion of said electrophotographic photosensitive member that does not contact said intermediate transfer belt, and the difference between the dark portion potential at the contact part and the dark portion potential at the non-contact portion, are respectively less than 20%, and no crack having a length of not less than 1 μm occurs in any of the surface of said electrophotographic photosensitive member and the surface of said intermediate transfer belt, when said electrophotographic photosensitive member and said intermediate transfer belt are brought into contact with each other under a linear pressure of 0.5 N/cm and left to stand for 336 hours in an environment of 45° C./95% RH.

7. The process cartridge according to claim 1, wherein said intermediate transfer belt has a volume resistivity of $1\times10^{6}$ to $8\times10^{13}$ Ω·cm and a wall thickness of 40 to 300 μm.

8. The process cartridge according to claim 1, wherein said intermediate transfer belt comprises a cut-tubular-support intermediate transfer belt produced by cutting a tubular film formed by melt extrusion whose diameter is controlled without a support until the film is cooled and solidified, wherein the melt-extrusion step forms a tubular film from a circular die by means of melt-extrusion;

wherein the diameter controlling step controls the diameter of the tubular film by injecting gas into the interior of the tubular film obtained in the melt-extrusion step to adjust the inner volume thereof;

wherein the forming step forms the tubular film without using any member supporting the tubular film until the tubular film controlled with respect to the diameter in the diameter controlling step is cooled and solidified, and wherein the cutting step cuts the tubular film obtained in the forming step to obtain said intermediate transfer belt.

9. The process cartridge according to claim 8, wherein the tubular film formed in the forming step has a wall thickness of not more than one third of a die gap of the circular die.

10. The process cartridge according to claim 8, wherein the tubular film formed in the forming step has a diameter of 101% to 300% of that of the circular die.

11. The process cartridge according to claim 1, wherein said intermediate transfer belt is placed over and around two rollers.

12. The process cartridge according to claim 11, wherein at least one of the rollers over and around which said intermediate transfer belt is placed slides by 1 mm or more, and has a mechanism to apply a force of not less than 5N toward said intermediate transfer belt.

13. The process cartridge according to claim 1, wherein said electrophotographic photosensitive member is in the form of a drum having a rigid body, and has a diameter of not more than 60 mm.

14. The process cartridge according to claim 1, wherein said electrophotographic photosensitive member has a layer containing a charge transporting material having a film thickness of 10 to 60 μm on a support member, and 20 to 80% of the weight of said layer containing said charge transporting material comprises said charge transporting material.

15. The process cartridge according to claim 14, wherein said layer containing said charge transporting material has a film thickness of 15 to 40 μm, and 30% to 60% of the weight of said layer containing said charge transporting material comprises said charge transporting material.

16. The process cartridge according to claim 1, wherein said electrophotographic photosensitive member has as a photosensitive layer, a lamination-type photosensitive layer having a charge generation layer containing charge generation material, and a charge transport layer containing charge transporting material, and wherein the charge transport layer contains polycarbonate or polyarylate.

17. The process cartridge according to claim 16, wherein said charge transporting material has a structure represented by the following formula (1) or a structure represented by the following formula (2)

(1)

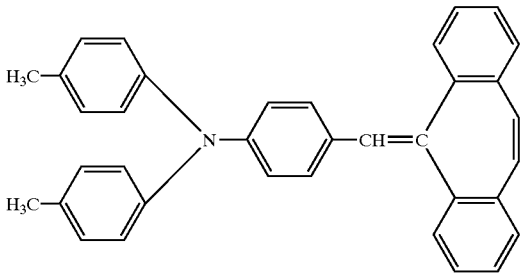

(2)

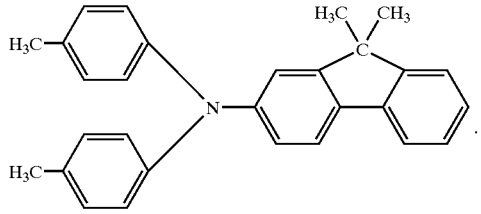

18. The process cartridge according to claim 17, wherein said electrophotographic photosensitive member contains both of a charge transporting material having a structure represented by said formula (1) and a charge transporting material having a structure represented by said formula (2).

19. An electrophotographic apparatus comprising:

an electrophotographic photosensitive member configured to carry a toner image;

charging means for electrically charging said electrophotographic photosensitive member;

exposing means for forming an electrostatic latent image on said electrophotographic photosensitive member charged with said charging means;

developing means for developing with a toner the electrostatic latent image formed with said exposing means on said electrophotographic photosensitive member to form a toner image on said electrophotographic photosensitive member;

an intermediate transfer belt having a contact part to contact said electrophotographic photosensitive member;

primary transfer means for primarily transferring the toner image from said electrophotographic photosensitive member to said intermediate transfer belt at said contact part;

secondary transfer means for secondarily transferring said toner image on said intermediate transfer belt to a transfer material; and charge providing means for providing electric charges having a polarity opposite to the polarity of the toner at the time of said primary transfer of the toner image on said intermediate transfer belt to return the toner on said intermediate transfer belt to said electrophotographic photosensitive member at said contact part to clean said intermediate transfer belt, wherein at least said electrophotographic photosensitive member, said intermediate transfer belt, said primary transfer means, and said charge providing means are integrally supported by a process cartridge being detachably mountable to a main body of said electrophotographic apparatus, and wherein said electrophotographic photosensitive member and said intermediate transfer belt are respectively configured so that the difference between the light portion potential at said contact part and the light portion potential at a non-contact portion of said electrophotographic photosensitive member that does not contact said intermediate transfer belt, and the difference between the dark portion potential at said contact part and the dark portion potential at said non-contact portion, are respectively less than 20%, and no crack having a length of not less than 1 $\mu$m occurs in any of the surface of said electrophotographic photosensitive member and the surface of said intermediate transfer belt, when said electrophotographic photosensitive member and said intermediate transfer belt are brought into contact with each other under a linear pressure of 0.5 N/cm and left to stand for 10 hours in an environment of 45° C./95% RH.

20. The electrophotographic apparatus according to claim 19, wherein said process cartridge further comprises integral electrophotographic photosensitive member cleaning means for cleaning said electrophotographic photosensitive member.

21. The electrophotographic apparatus according to claim 20, wherein said electrophotographic photosensitive member cleaning means comprises blade cleaning means having an elastic blade.

22. The electrophotographic apparatus according to claim 19, wherein said process cartridge is separable into an electrophotographic photosensitive member unit having said electrophotographic photosensitive member and an intermediate transfer belt unit having said intermediate transfer belt, and has connecting means for connecting said electrophotographic photosensitive member unit and said intermediate transfer belt unit.

23. The electrophotographic apparatus according to claim 19, wherein said electrophotographic photosensitive member and said intermediate transfer belt are respectively configured so that the difference between the light portion potential at said contact part and the light portion potential at said non-contact portion of said electrophotographic photosensitive member that does not contact said intermediate transfer belt, and the difference between the dark portion potential at said contact part and the dark portion potential at said non-contact portion, are respectively less than 20%, and no crack having a length of not less than 1 $\mu$m occurs in any of the surface of said electrophotographic photosensitive member and the surface of said intermediate transfer belt, when said electrophotographic photosensitive member and said intermediate transfer belt are brought into contact with each other under a linear pressure of 0.5 N/cm and left to stand for 336 hours in an environment of 45° C./95% RH.

24. The electrophotographic apparatus according to claim 19, wherein said intermediate transfer belt has a volume resistivity of $1\times10^{6}$ to $8\times10^{13}$ $\Omega\cdot$cm and a wall thickness of 40 to 300 $\mu$m.

25. The electrophotographic apparatus according to claim 19, wherein said intermediate transfer belt comprises a cut-tubular-support intermediate transfer belt produced by cutting a tubular film formed by melt extrusion whose diameter is controlled without a support until the film is cooled and solidified, wherein the melt-extrusion step forms a tubular film from a circular die by means of melt-extrusion, wherein the diameter controlling step controls the diameter of the tubular film by injecting gas into the interior of the tubular film obtained in the melt-extrusion step to adjust the inner volume thereof;

wherein the forming step forms the tubular film without using any member supporting the tubular film until the tubular film controlled with respect to the diameter in the diameter controlling step is cooled and solidified, and wherein the cutting step cuts the tubular film obtained in the forming step to obtain said intermediate transfer belt.

26. The electrophotographic apparatus according to claim 25, wherein the tubular film formed in the forming step has a wall thickness of not more than one third of a die gap of the circular die.

27. The electrophotographic apparatus according to claim 25, wherein the tubular film formed in the forming step has a diameter of 101% to 300% of that of the circular die.

28. The electrophotographic apparatus according to claim 19, wherein said intermediate transfer belt is placed over and around two rollers.

29. The electrophotographic apparatus according to claim 28, wherein at least one of the rollers over and around which said intermediate transfer belt is placed slides by 1 mm or more, and has a mechanism to apply a force of not less than 5 N toward the intermediate transfer belt.

30. The electrophotographic apparatus according to claim 19, wherein said electrophotographic photosensitive member is in the form of a drum having a rigid body, and has a diameter of not more than 60 mm.

31. The electrophotographic, apparatus according to claim 19, wherein said electrophotographic photosensitive member has a layer containing a charge transporting material having a film thickness of 10 to 60 $\mu$m on a support member, and wherein 20 to 80% of the weight of the layer containing the charge transporting material comprises the charge transporting material.

32. The electrophotographic apparatus according to claim 31, wherein the layer containing the charge transporting material has a film thickness of 15 to 40 $\mu$m, and 30 to 60% of the weight of the layer containing the charge transporting material comprises the charge transporting material.

33. The electrophotographic apparatus according to claim 19, wherein said electrophotographic photosensitive member has as a photosensitive layer, a lamination-type photosensitive layer having a charge generation layer containing charge generation material, and a charge transport layer containing charge transporting material, and wherein the charge transport layer contains polycarbonate or polyarylate.

34. The electrophotographic apparatus according to claim 19, wherein said electrophotographic photosensitive member contains a charge transporting material having a structure represented by the following formula (1) or a charge transporting material having a structure represented by the following formula (2)

(1)

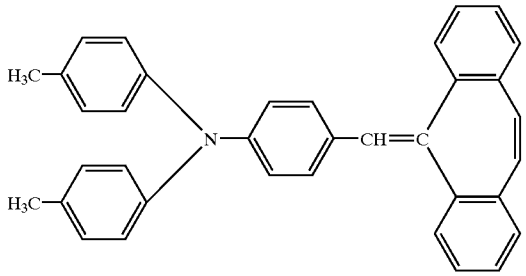

(2)

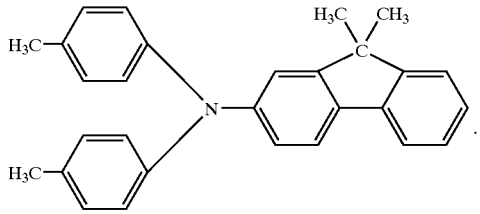

35. The electrophotographic apparatus according to claim 34, wherein said electrophotographic photosensitive member contains both of a charge transporting material having a structure represented by said formula (1) and a charge transporting material having a structure represented by said formula (2).

* * * * *

UNITED STATES PATENT AND TRADEMARK OFFICE

CERTIFICATE OF CORRECTION

PATENT NO. : 6,795,667 B2
DATED : September 21, 2004
INVENTOR(S) : Akihiko Nakazawa et al.

It is certified that error appears in the above-identified patent and that said Letters Patent is hereby corrected as shown below:

Title page,
Item [57], ABSTRACT,
Line 10, “with under” should read -- with the photosensitive member under --.

Column 2,
Line 42, “originated” should read -- originating --.

Column 4,
Line 1, “left” should read -- may be left --.
Line 16, “those which have solved” should read -- remedies for solving --.

Column 7,
Line 13, “molecule” should read -- molecular --.

Column 8,
Line 19, “diphenylarnine” should read -- diphenylamine --.

Column 9,
Line 16, “alloy” should read -- alloys --.

Column 10,
Line 11, “gives” should read -- giving --.
Line 26, “to” should read -- from --.

Column 11,
Line 9, “intermediate,” should read -- intermediate --.
Line 35, “each other.” should read -- with one another --.
Line 44, “beside” should read -- besides --.

Column 12,
Line 47, “weight production” should read -- weight reduction --.
Line 51, “one third” should read -- one-third --.
Line 52, “one fifth” should read -- one-fifth --.

UNITED STATES PATENT AND TRADEMARK OFFICE

CERTIFICATE OF CORRECTION

PATENT NO. : 6,795,667 B2
DATED : September 21, 2004
INVENTOR(S) : Akihiko Nakazawa et al.

It is certified that error appears in the above-identified patent and that said Letters Patent is hereby corrected as shown below:

Column 13,
Line 9, “silicon” should read -- silicone --; and polyvinylinde” should read -- polyvinylidene --.
Line 49, “alternate” should read -- alternating --.
Line 50, “only the direct current will do” should read -- a direct current alone will do. --.
Line 65, “forth” should read -- fourth --.

Column 14,
Lines 4 and 35, “forth” should read -- fourth --.

Column 16,
Line 32, “to the” should read -- the --.
Line 55, “will not be arranged not to diffuse” should read -- will not diffuse --.

Column 17,
Line 3, “arc” should read -- are --.
Line 18, “alternate” should read -- alternating --.
Line 23, “erase” should read -- erases --.

Column 18,
Line 6, “puncher” should read -- punch --.
Line 30, “carrying” should read -- carried --.

Column 19,
Line 32, “47 mm.” should read -- 47mm was produced. --.

Column 20,
Lines 53 and 58, “one-day” should read -- one day --.

Column 21,
Line 3, “this is composed of as the main components” should read -- the main components --.
Line 5, “252,the” should read -- 252, are the --.
Line 28, “hook part” should read -- a hook part --.

Column 23,
Line 13, “polyvinyliden” should read -- polyvinylidene --.

UNITED STATES PATENT AND TRADEMARK OFFICE

CERTIFICATE OF CORRECTION

PATENT NO. : 6,795,667 B2
DATED : September 21, 2004
INVENTOR(S) : Akihiko Nakazawa et al.

It is certified that error appears in the above-identified patent and that said Letters Patent is hereby corrected as shown below:

Column 24,
Line 50, “occurred” should read -- that appeared --.

Column 25,
Line 4, “butylenes” should read -- butylene --.
Line 5, “(tolylene” should read -- tolylene --.
Line 16, “it was supposed” should read -- it was noted --.

Column 26,
Line 63, “can plan” should read -- makes possible --.

Column 28,
Line 37, “one third” should read -- one-third --.

Column 31,
Line 15, “one third” should read -- one-third --.

Signed and Sealed this

Fifteenth Day of February, 2005

JON W. DUDAS
*Director of the United States Patent and Trademark Office*